US005640642A

United States Patent [19]

Nakane et al.

[11] Patent Number: 5,640,642

[45] Date of Patent: Jun. 17, 1997

[54] PROCESSING APPARATUS FOR LIGHT-SENSITIVE MATERIAL

[75] Inventors: Nobu Nakane; Yutaka Osone; Yoshifumi Tsubaki; Ryuji Uesugi, all of Hino, Japan

[73] Assignee: Konica Corporation, Tokyo, Japan

[21] Appl. No.: 294,110

[22] Filed: Aug. 22, 1994

[30] Foreign Application Priority Data

Aug. 31, 1993 [JP] Japan ..... 5-216487

[51] Int. Cl.[6] ..... G03D 3/02

[52] U.S. Cl. ..... 396/626

[58] Field of Search ..... 354/324, 298; 430/398–400, 450, 465; 221/3, 15; 137/268

[56] References Cited

U.S. PATENT DOCUMENTS

| | | | |
|---|---|---|---|
| 3,563,384 | 2/1971 | DeLaney et al. | 137/268 |
| 4,155,638 | 5/1979 | Blitzer | 118/646 X |
| 4,293,211 | 10/1981 | Kaufman | 354/298 |
| 4,300,828 | 11/1981 | Kaufmann | 354/322 |
| 4,650,308 | 3/1987 | Burbury | 354/322 X |
| 4,911,327 | 3/1990 | Shepherd et al. | 221/3 |
| 4,980,292 | 12/1990 | Elbert et al. | 221/3 |
| 5,025,279 | 6/1991 | Ellsworth | 354/298 |
| 5,080,552 | 1/1992 | Takahashi et al. | 221/298 |
| 5,151,731 | 9/1992 | Yamada et al. | 354/324 |
| 5,184,164 | 2/1993 | Kose et al. | 354/298 |
| 5,316,898 | 5/1994 | Ueda | 430/300 |
| 5,318,061 | 6/1994 | Saito | 354/324 |
| 5,351,103 | 9/1994 | Komatsu et al. | 354/324 |
| 5,366,853 | 11/1994 | Yoshimoto | 430/400 |
| 5,378,588 | 1/1995 | Tsuchiya | 430/428 |
| 5,400,105 | 3/1995 | Koboshi et al. | 354/324 |
| 5,432,583 | 7/1995 | Ishikawa et al. | 354/324 |

FOREIGN PATENT DOCUMENTS

0068872 A1 1/1983 European Pat. Off. .

*Primary Examiner*—D. Rutledge

*Attorney, Agent, or Firm*—Frishauf, Holtz, Goodman, Langer & Chick

[57] ABSTRACT

A processing apparatus for a light-sensitive material includes a plurality of processing tanks for processing light-sensitive material; a kit including a container for accommodating a number of solid processing agents used for each processing tank; and solid processing agent replenishing device for replenishing the solid processing agents accommodated in the container into each processing tank. The apparatus further includes a memory for storing an amount of each solid processing agent used for processing a predetermined amount of light-sensitive material; a residual amount detector for detecting a residual amount of each solid processing agent and outputting a used up solid-processing-agent signal when the residual amount of each solid processing agent becomes zero; and a replacement requesting device for requesting the replacement of all solid processing agents in accordance with the used up solid-processing-agent signal of the solid processing agent.

23 Claims, 16 Drawing Sheets

PROCESSING APPARATUS FOR LIGHT-SENSITIVE MATERIAL

BACKGROUND OF THE INVENTION

The present invention relates to a processing apparatus for light-sensitive material, and more particularly relates to a processing apparatus for light-sensitive material in which a powder, granule or tablet type of solid processing agent is charged into a processing tank so as to be dissolved into a solution, and light-sensitive material is subjected to development in the processing solution.

In the conventional processing apparatus for light-sensitive material in which light-sensitive material is subjected to development, a replenishing solution to be charged into the apparatus is put in a transparent bottle. Therefore, an amount of the residual processing solution can be visually checked. Even when all the processing agent has been consumed, it can be immediately recognized, so that a display of the residual amount of the processing solution is not required. When the replenishing agent is used in the form of a processing solution, bottles to accommodate the processing solution are bulky and heavy, so that transportation and charge of the replenishing processing agent is not easy, and further environmental pollution such as smell is caused.

In order to solve the above problems, it can be considered to use solid processing agent in the form of powder, granules or tablets. The replenishing processing agent in the form of powder, granules or tablets can be easily supplied to the processing apparatus. However, unless the replenishing agent is supplied in an appropriate timed relation, the quality of processed light-sensitive material is deteriorated. In the case where the solid processing agent is mistakenly dropped outside the processing tank, an amount of the processing agent to be replenished becomes unbalanced. It is necessary that even an unskilled worker can control the charge of solid processing agent.

The present invention is to provide a processing apparatus for light-sensitive material capable of being operated by an unskilled worker, and the worker can safely charge the replenishing agent into the processing tank.

In the apparatus of the invention, the solid processing agent is accommodated in a cylindrical accommodating container (cartridge). Then the cylindrical accommodating container is set in a solid processing agent charging device of the automatic developing apparatus, and a predetermined amount of processing agent is supplied to a processing tank such as a developing or fixing tank. When a predetermined amount of processing agent is supplied, a large amount of solid processing agent is supplied to some tanks, and a small amount of solid processing agent is supplied to other tanks. In this case, a plurality of types of solid processing agents are packaged in one kit, wherein an amount of each solid processing agent is appropriately determined so as to meet the requirement for processing. As described above, an amount of each processing agent necessary for processing a predetermined amount of light-sensitive material is different for each processing tank. Therefore, the number of pieces of the solid processing agent in one kit is different for each processing tank. As one kit is provided in the above manner, when the development of a predetermined amount of light-sensitive material has been completed, all the solid processing agents in one kit are simultaneously consumed.

In this way, the processing agent can be controlled in the form of a kit. Accordingly, the stock control of the processing agent can be simplified, so that the processing agent in each processing tank can be controlled under the same condition. In an embodiment in which one kit of the solid processing agent is accommodated in one cartridge as it is, each cartridge corresponding to each processing tank can be replaced in the same timed relation, so that labor can be saved in the replacement of the cartridge. Since each cartridge corresponding to each processing tank can be simultaneously replaced, excellent effect can be provided in an embodiment in which the light-sensitive material processing operation must be stopped while the cartridge is being replaced.

In general, quality of the processing agent varies from lot to lot. Therefore, it is preferable that the processing agent of the same lot is used in the processing of light-sensitive material. Usually, the processing agents in one kit belong to the same lot. Therefore, when the processing agents are replaced in the unit of a kit, processing can be preferably executed.

As described above, when a kit of the solid processing agent is controlled, development of light-sensitive material can be very effectively controlled. However, when the above method is put into practical use, various problems are caused. For example, for some reasons (abnormality of the apparatus, abnormality of the solid processing agent, and the lack of the solid processing agent), one type of solid processing agent is consumed. In this case, a cartridge in which the solid processing agent has been consumed must be replaced. Therefore, the number of replacement is increased, and the solid processing agent of a different lot is simultaneously charged into the processing tank, and kit control becomes out of order.

SUMMARY OF THE INVENTION

It is an object of the present invention to provide a light-sensitive material processing apparatus in which kit control can be easily conducted even when a specific solid processing agent is lacking for some reason.

The first embodiment of the present invention comprises: a plurality of processing tanks for processing light-sensitive material; an accommodating container for accommodating each solid processing agent used for each processing tank; a solid processing agent replenishing means for replenishing the solid processing agent accommodated in the accommodating container into each processing tank; a memory means for storing an amount of each solid processing agent used for processing a predetermined amount of light-sensitive material; a residual amount detecting means for detecting a residual amount of each solid processing agent and outputting a no-solid-processing-agent signal when the residual amount of each solid processing agent becomes zero; and a replacement requesting means for requesting the replacement of all solid processing agents in accordance with the no-solid-processing-agent signal of the solid processing agent.

The second embodiment of the present invention comprises: a plurality of processing tanks for processing light-sensitive material; an accommodating container for accommodating each solid processing agent used for each processing tank; a solid processing agent replenishing means for replenishing the solid processing agent accommodated in the accommodating container into each processing tank; a memory means for storing an amount of each solid processing agent used for processing a predetermined amount of light-sensitive material; a residual amount detecting means for detecting a residual amount of each solid processing agent and outputting a no-solid-processing-agent signal when the residual amount of each solid processing agent becomes zero; and a control means for controlling the replenishing so as to replenish the solid processing agent to the processing tank.

The third embodiment of the present invention comprises: a plurality of processing tanks for processing light-sensitive material; an accommodating container for accommodating each solid processing agent used for each processing tank; a solid processing agent replenishing means for replenishing the solid processing agent accommodated in the accommodating container into each processing tank; a memory means for storing an amount and characteristics of each solid processing agent used for processing a predetermined amount of light-sensitive material; a residual amount detecting means for detecting a residual amount of each solid processing agent and outputting a no-solid-processing-agent signal when the residual amount of each solid processing agent becomes zero; and a replacement requesting means for requesting the replacement of all solid processing agents when the number of replenishing signals has reached a replenishment delay critical number after the generation of the no-solid-processing-agent signal.

The fourth embodiment of the present invention comprises: a plurality of processing tanks for processing light-sensitive material; an accommodating container for accommodating each solid processing agent used for each processing tank; a solid processing agent replenishing means for replenishing the solid processing agent accommodated in the accommodating container into each processing tank; a memory means for storing an amount of each solid processing agent used for processing a predetermined amount of light-sensitive material; a replenishment control means for controlling an amount of the solid processing agent in accordance with the processing of a predetermined amount of light-sensitive material; and a correction controlling means for changing a ratio of an amount of solid processing agent to be replenished to a predetermined amount of light-sensitive material.

In the processing apparatus for light-sensitive material of the first embodiment of the present invention, when the solid processing agent of a kit in a specific processing tank has been consumed, replacement of the kit is required even when surplus solid processing agents remain in other processing tanks.

In the processing apparatus for light-sensitive material of the second embodiment of the present invention, when the solid processing agent of a kit in a specific processing tank has been consumed, and when surplus solid processing agents remain in other processing tanks, all the surplus solid processing agents are forcibly replenished to the processing tanks.

In the processing apparatus for light-sensitive material of the third embodiment of the present invention, even when the solid processing agent of a kit in a specific processing tank has been consumed, the replenishing operation is continued, and when the number of vacant replenishment signals of the processing tank has reached the critical number of replenishment delay, replacement of the kit is required. In this case, the number of vacant replenishment signals is defined as the number of signals of replenishing motions under the condition that the solid processing agent is not charged. Also, the critical number of replenishment delay is defined as the critical number at which the processing characteristics are not deteriorated even when vacant replenishing operation is repeated.

In the processing apparatus for light-sensitive material of the fourth embodiment of the present invention, when a predetermined amount of light-sensitive material is processed, a predetermined amount of solid processing agent is consumed, and when an amount of solid processing agent of a kit has been reduced too small during the developing operation, computation is conducted again, and an amount of the solid processing agent to be replenished is corrected to a value different from the above predetermined value by a correcting and controlling means. In this way, correction control is conducted.

DETAILED DESCRIPTION OF THE PREFERRED EMBODIMENTS

An example of the processing apparatus for light-sensitive material of the present invention will be explained as follows.

Figure 1:
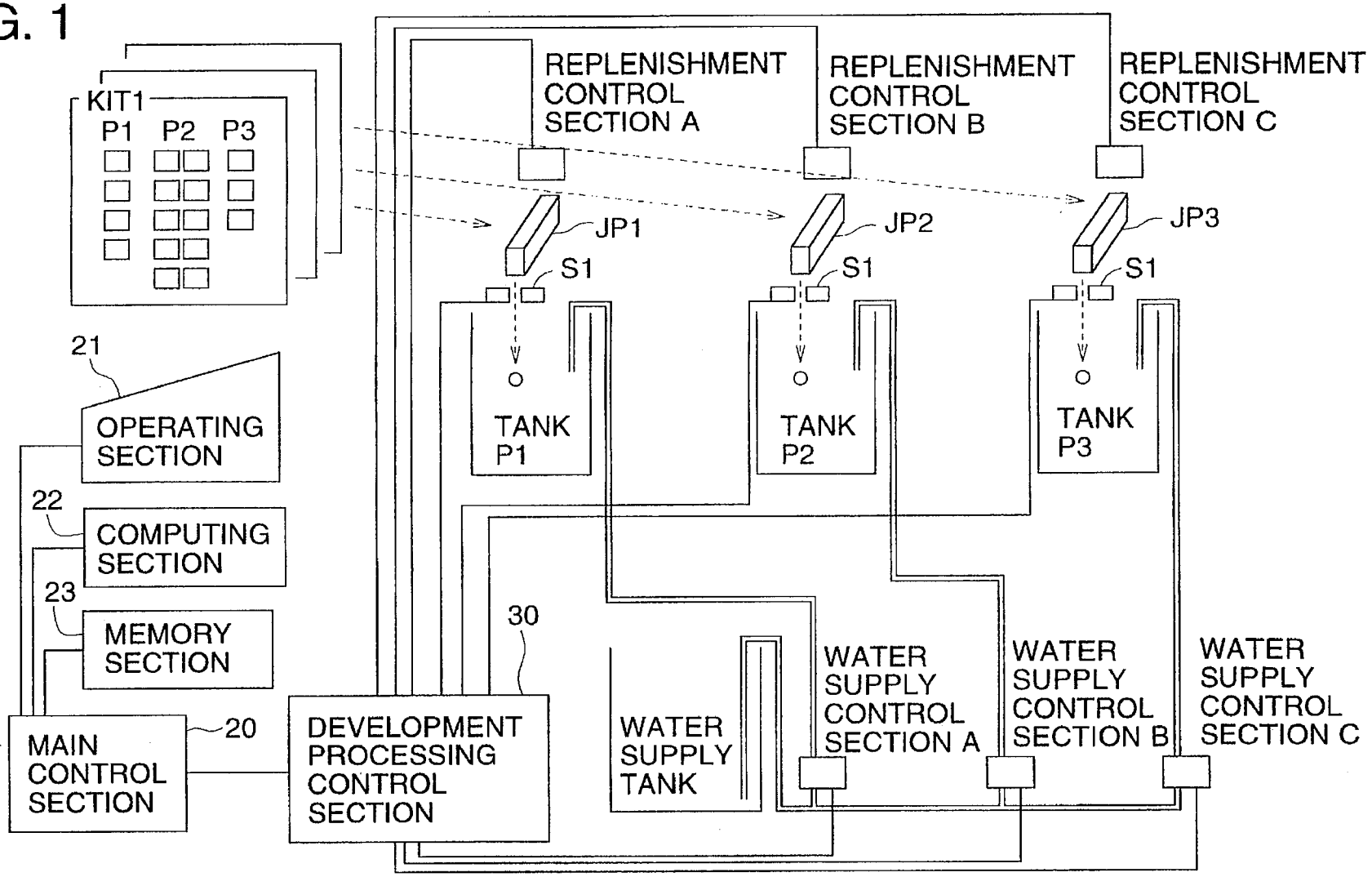
FIG. 1 is an overall arrangement view of the automatic developing apparatus of the present invention.
Figure 2:
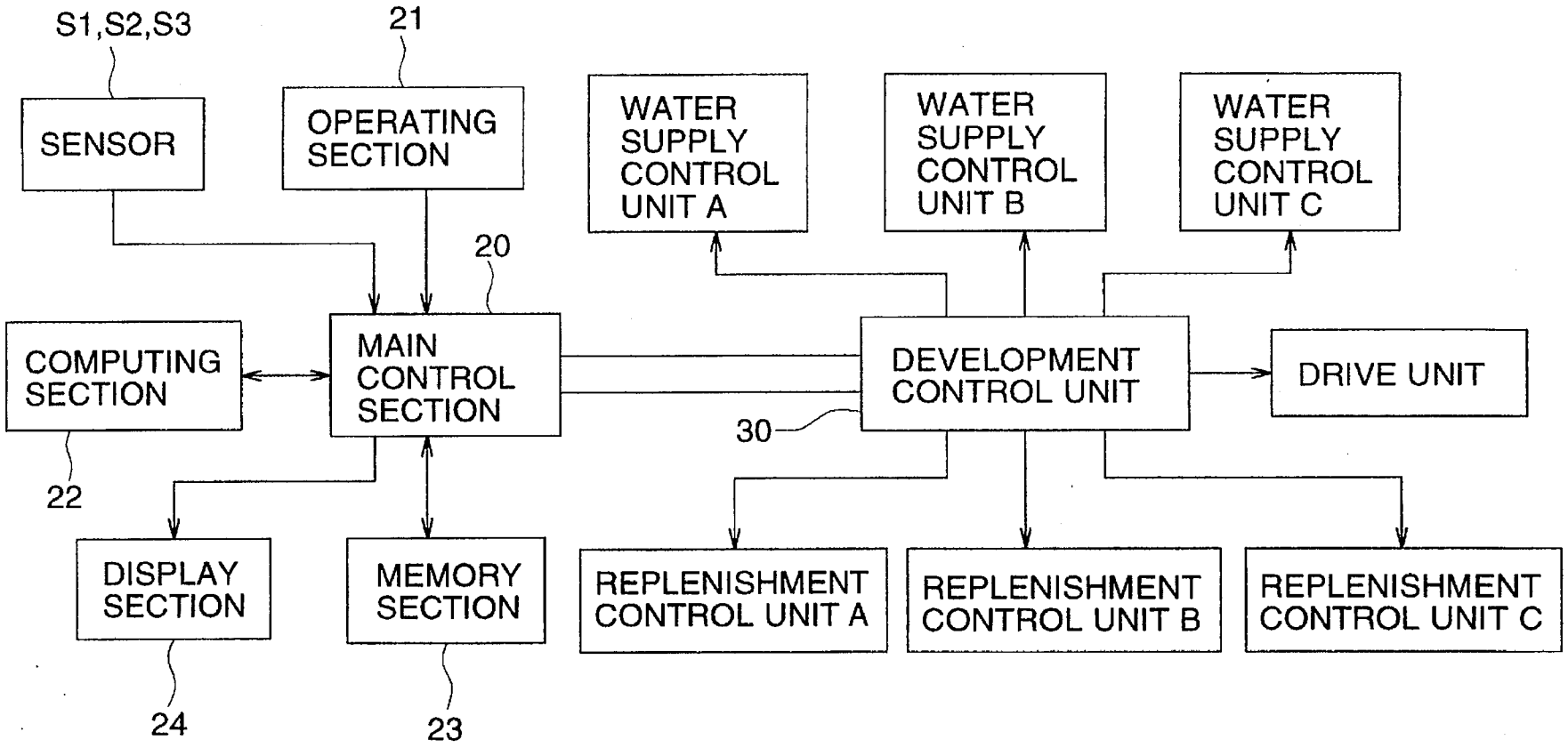
FIG. 2 is a block diagram showing the replenishment control system of the automatic developing apparatus of the present invention.

In the processing apparatus explained below, a tablet type solid processing agent is used. In this case, the solid processing agent is not limited to the tablet type. The granular type or powder type solid precessing agent may be used. Further, the configuration and dimensions of tablets corresponding to each processing tank may not be necessarily the same. In this example, the automatic developing unit includes three processing tanks, however, it should be noted that a light-sensitive material processing apparatus having a plurality of processing tanks is included in the scope of claim of the present invention. FIG. 1 is a view showing the construction of the automatic developing apparatus of the present invention. FIG. 2 is a block diagram showing the replenishment control system of the automatic developing apparatus of the present invention.

As illustrated in FIG. 1, the automatic developing apparatus of this example includes processing tanks P1, P2 and P3 for development, fixing and stabilization. A long light-sensitive material is conveyed into each processing tank and successively dipped in the solution. Examples of light-sensitive material subjected to development in these processing tanks are: a color negative film, color positive film, monochromatic negative film, monochrommatic positive film, X-ray film, film used for printing, and color photographic paper.

Each of the processing tanks (P1, P2, P3) is provided with the same solid processing agent charging unit. Cartridges (JP1, JP2, JP3) included in a kit have tablets of solid processing agent. The cartridges are respectively attached to the processing tanks (P1, P2, P3). In this example, the configurations of the cartridges (JP1, JP2, JP3) are cylindrical, and they are approximately the same. On the surfaces of the cartridges (JP1, JP2, JP3), there is provided information about the type of the tablets. The configuration of the tablet is either disk-shaped, spherical or cylindrical. The volume of the tablet is predetermined.

Figure 3:
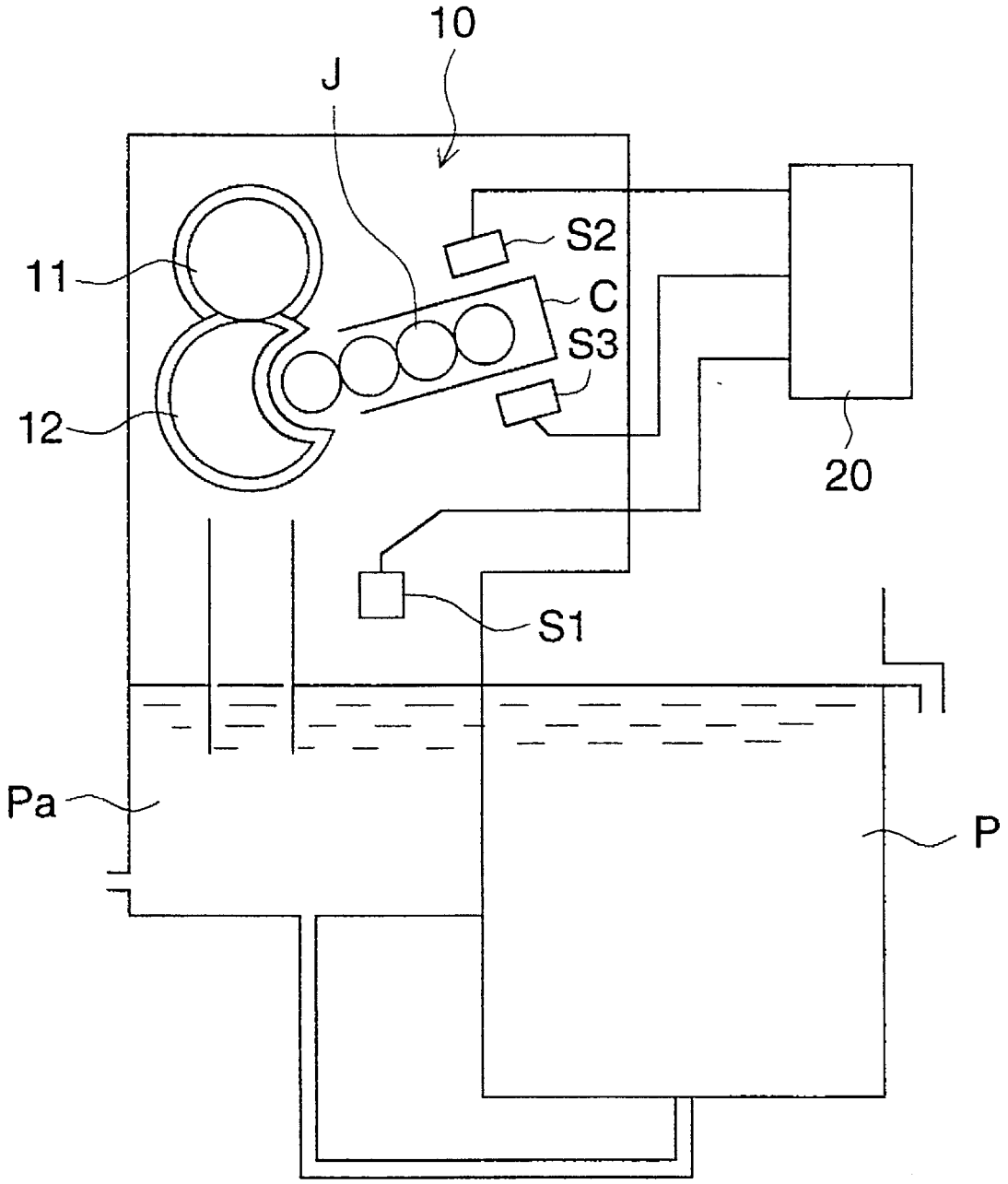
FIG. 3 is a view showing the construction of the solid processing agent charging unit.

After the cartridge JP has been opened, it is attached to a solid processing agent charging unit 10 so that the tablets of solid processing agent can be dropped as illustrated in FIG. 3. There are provided sensors S1, S2, S3 close to the charging unit 10. The sensor S1 is a tablet detection sensor for detecting the number of the tablets J to be charged into the processing tank. The sensor S2 is used for detecting that the cartridge JP has been attached to the charging unit 10. The sensor S3 is used for detecting the type of the cartridge JP (the kit number or lot number) and the type of tablets. The type detection sensor S3 comprises an optical sensor by which a projection formed on the outer surface of the cartridge is detected, and also a bar code stuck on the outer surface of the cartridge is detected. Alternatively, a plurality of mechanical microswitches are used for detecting the number of tablets. Alternatively, a transparent cartridge may be adopted so that a color of the tablet charged inside can be detected.

Concerning the sensor S2 for detecting the existence of the cartridge, a microswitch or a reflection type optical sensor may be employed. Alternatively, a magnetic sensor in which a dielectric constant or magnetic permeability is used for detection may be used when a ferromagnetic body is attached onto the outer surface of the container.

Concerning the sensor S1 for detecting the tablet, an optical sensor is used, by which the number of dropping tablets J is optically detected. When the solid processing agent is granule, a weight detecting type sensor is preferably used. Concerning the sensor S2, when a transparent cartridge is used, an optical detecting type sensor may be used. However, when it is preferable to avoid the use of light, detection of the sensor S2 may be conducted by using a difference of the dielectric constant between air and tablets, or alternatively detection of the sensor S2 may be conducted by using weight.

After the cartridge JP has been attached to the charging unit 10, a drive section 11 is driven so that a conveyance drum 12 is rotated. While the conveyance drum 12 is rotated by one revolution, one tablet J is discharged from the cartridge JP and charged into a replenishing tank Pa in accordance with the control of a main control section 20.

In the block diagram in FIG. 2 in which the replenishment control system is illustrated, the main control section 20 controls the entire automatic developing apparatus. In FIG. 2, the operating section 21 is an inputting device such as a keyboard and switch, the computing section 22 is a computing unit for computing the replenishing time, the memory section 23 is a memory for storing parameters concerning replenishment control, and the display section 24 is made of liquid crystals, wherein the display section 24 is used when the replacement request of the cartridge or kit is displayed. The development control section 30 is a control unit for controlling the development processing. The replenishment control units SPJ (A, B, C) are units for replenishing the tablets. The water supply control units SPW (A, B, C) are units for supplying water.

In the replenishment control system of the present invention, the solid processing agent is supplied to each processing tank in accordance with the information sent from a throughput detection means (not shown). In the replenishment control system, the number of tablets of each processing tank for each kit is stored in the memory section 23. The number of charged tablets detected by the sensor S1 is computed by the computing section 22, so that the residual amount of tablets for each kit is computed. An amount of the solid processing agent not charged into the processing tank (referred to as a not-replenished amount) is inputted into the operating section 21. Of course, this not-replenished amount may be detected by a detection means provided separately. Concerning the water supply to each processing tank, an amount of supplied water for each kit is stored and computed.

Figure 4:
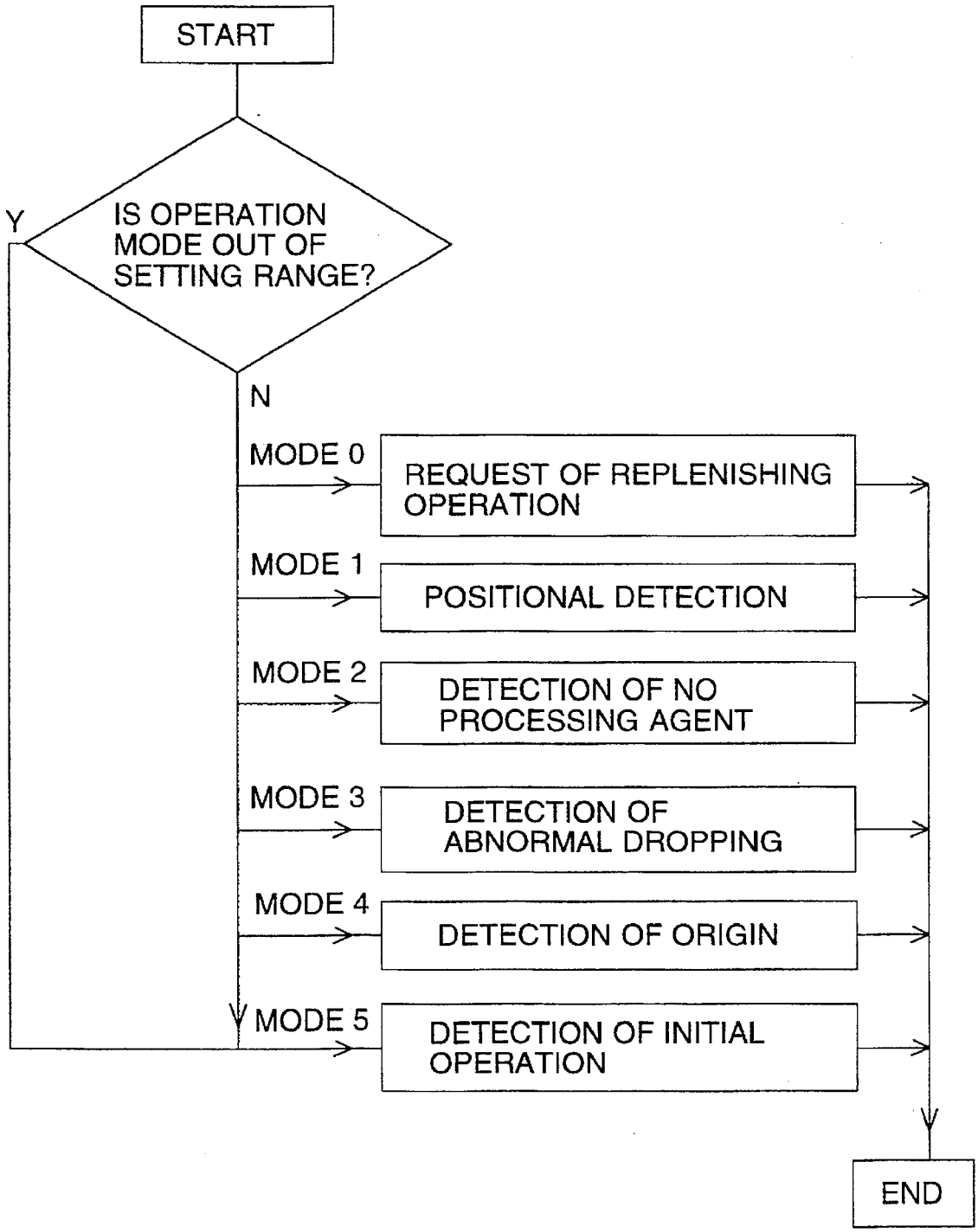
FIG. 4 is a view showing the flow of replenishment control (main processing).

Next, replenishment control conducted by the processing agent charging unit 10 will be explained as follows. FIG. 4 is a diagram showing a main flow of replenishment control of the solid processing agent. This flow comprises the operation modes 0 to 5. When the operation is out of the replenishment setting range, the initial operation detection (mode 5) is immediately conducted. On the other hand, when the operation is in the replenishment setting range, the operation is conducted in accordance with the modes 0 to 5. The modes 1 to 4 show an error detection flow in which the occurrence of abnormality of replenishing operation is judged by the information detected by each sensor shown in FIG. 2, and the error is displayed. The types of errors detected here are a replenishment position detection error, no-processing-agent error, abnormal dropping, and origin detection (home position) error.

Figure 5:
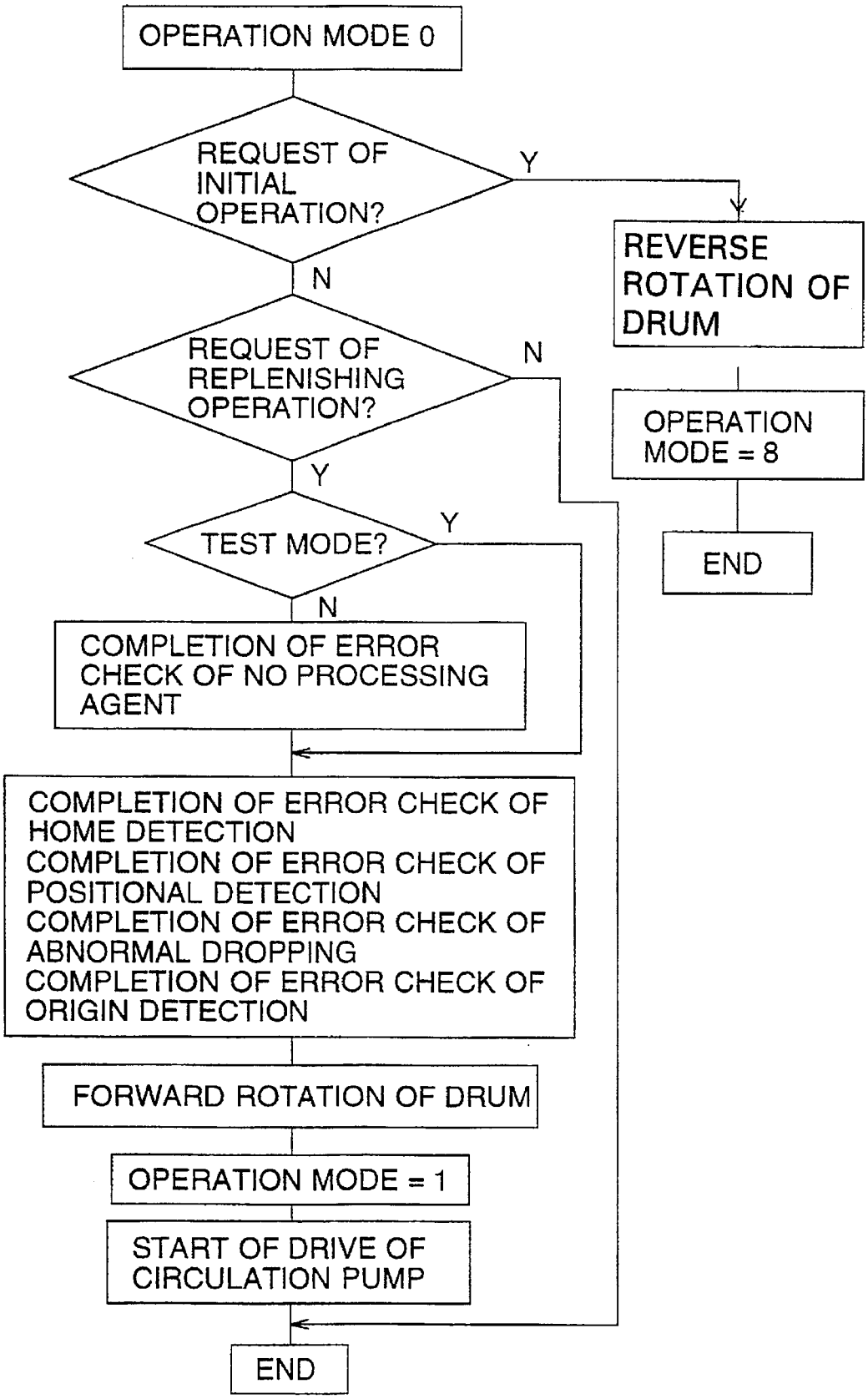
FIG. 5 is a view showing the flow of replenishment control (operation mode 0).

FIG. 5 is a replenishment control flow including the operation mode 0 in which operation is stopped, and also including the check of the request of operation. The replenishment operation starts in accordance with the replenishment operation request sent from the replenishment control unit. The flow is divided into two according to whether the initial operation request exists or not. In this case, the initial operation request is made either automatically or manually.

In this case, the initial operation request is made manually, the program advances according to the flow Y. In this flow chart, "drum" represents the conveyance drum 12 of the charging unit 10.

Figure 6:
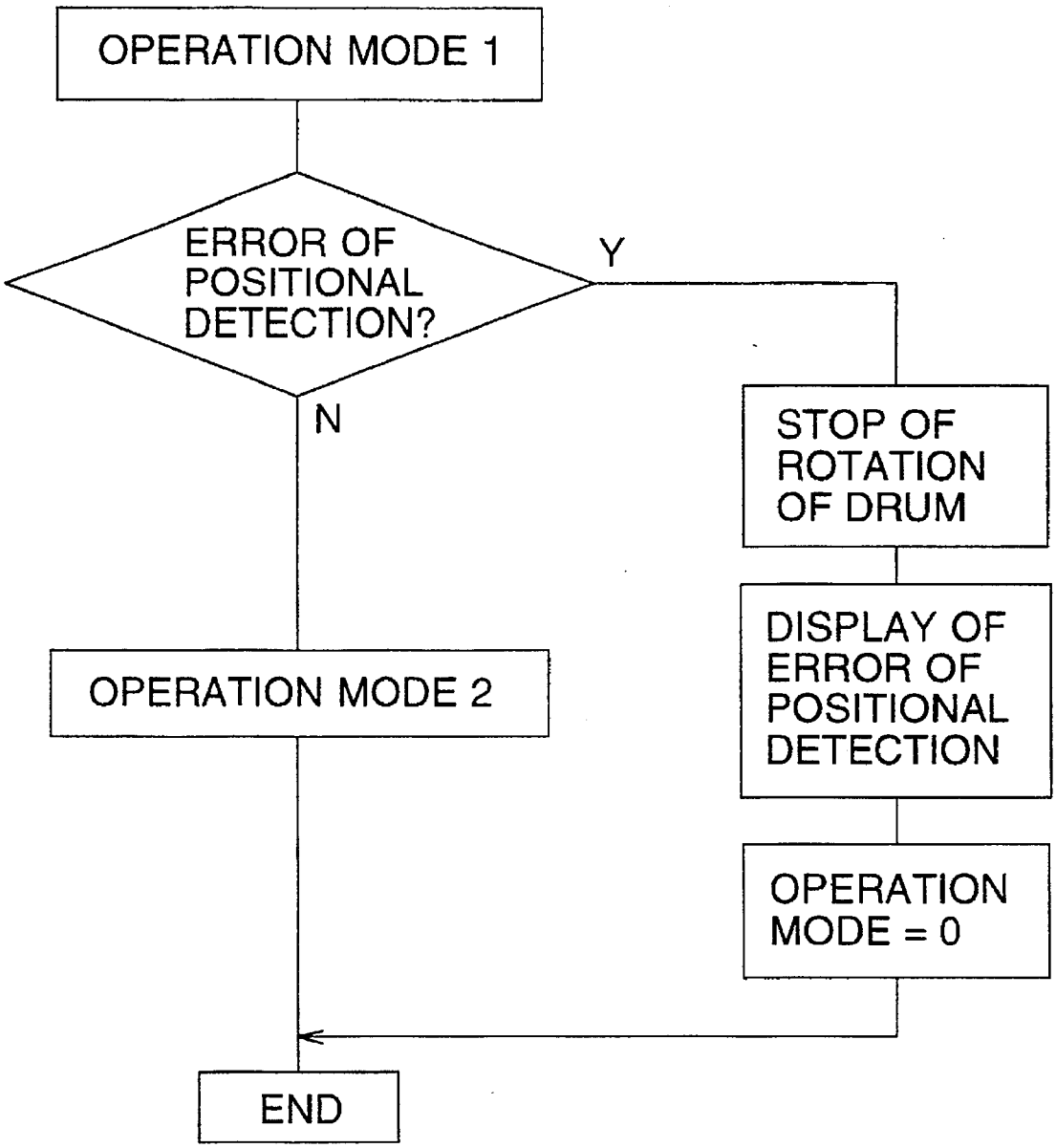
FIG. 6 is a flow of replenishment control (operation mode 1).

FIG. 6 is a control flow for checking the positional detection error in the operation mode 1. In this control flow, the error of tablet charging detected by the sensor S1 is checked.

Figure 7:
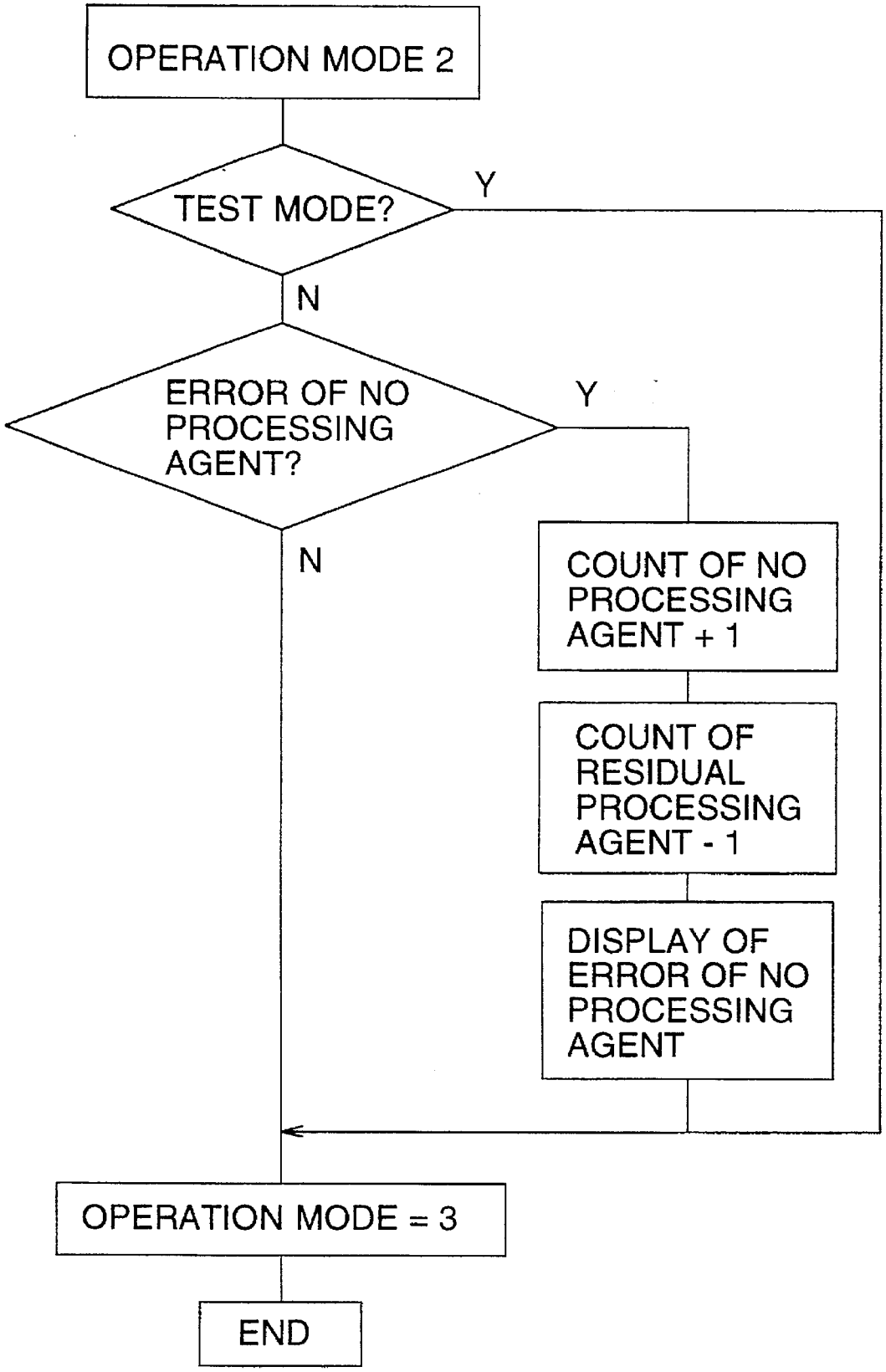
FIG. 7 is a flow of replenishment control (operation mode 2).

FIG. 7 is a replenishment control flow in which the error of no-processing-agent of the operation mode 2 is checked. In this flow chart, "no-processing-agent count +1" and "processing agent residual amount count −1" are processing which relates to the printing operation conducted later.

Figure 8:
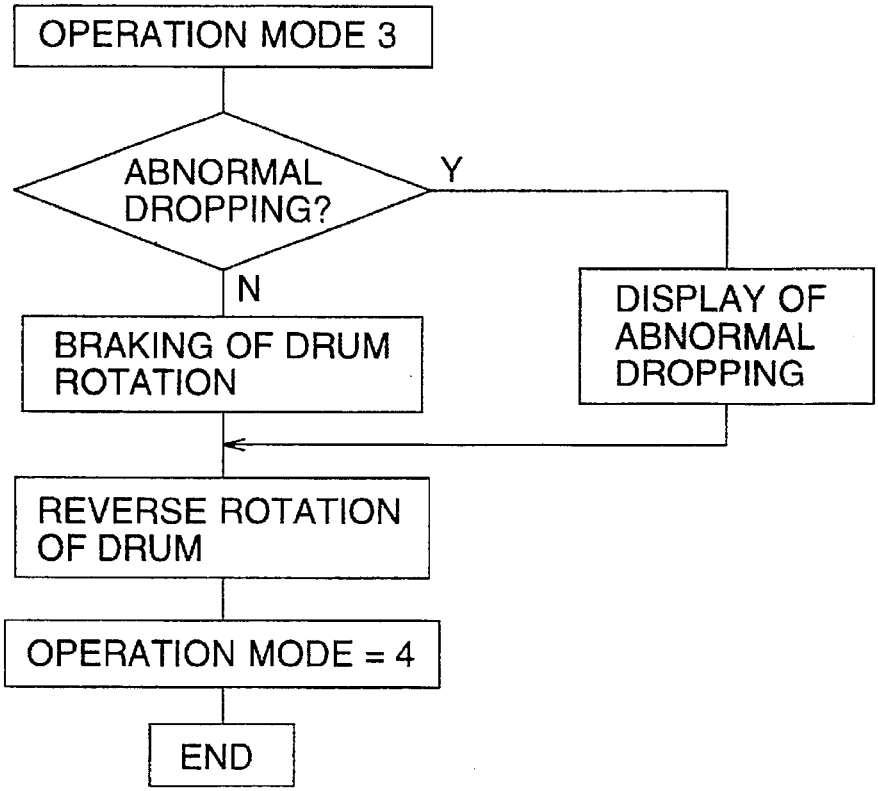
FIG. 8 is a flow of replenishment control (operation mode 3).
Figure 9:
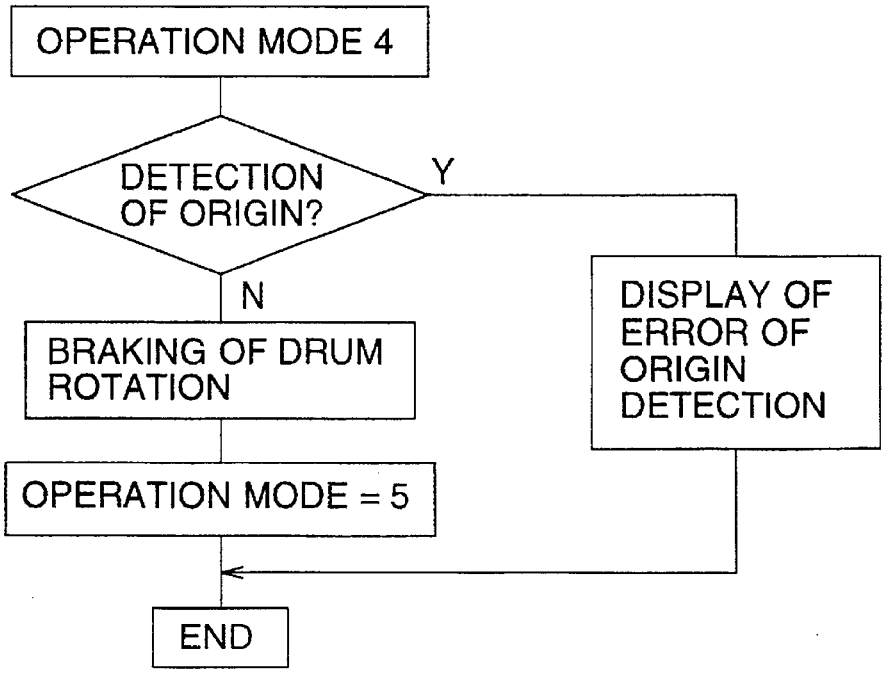
FIG. 9 is a flow of replenishment control (operation mode 4).
Figure 10:
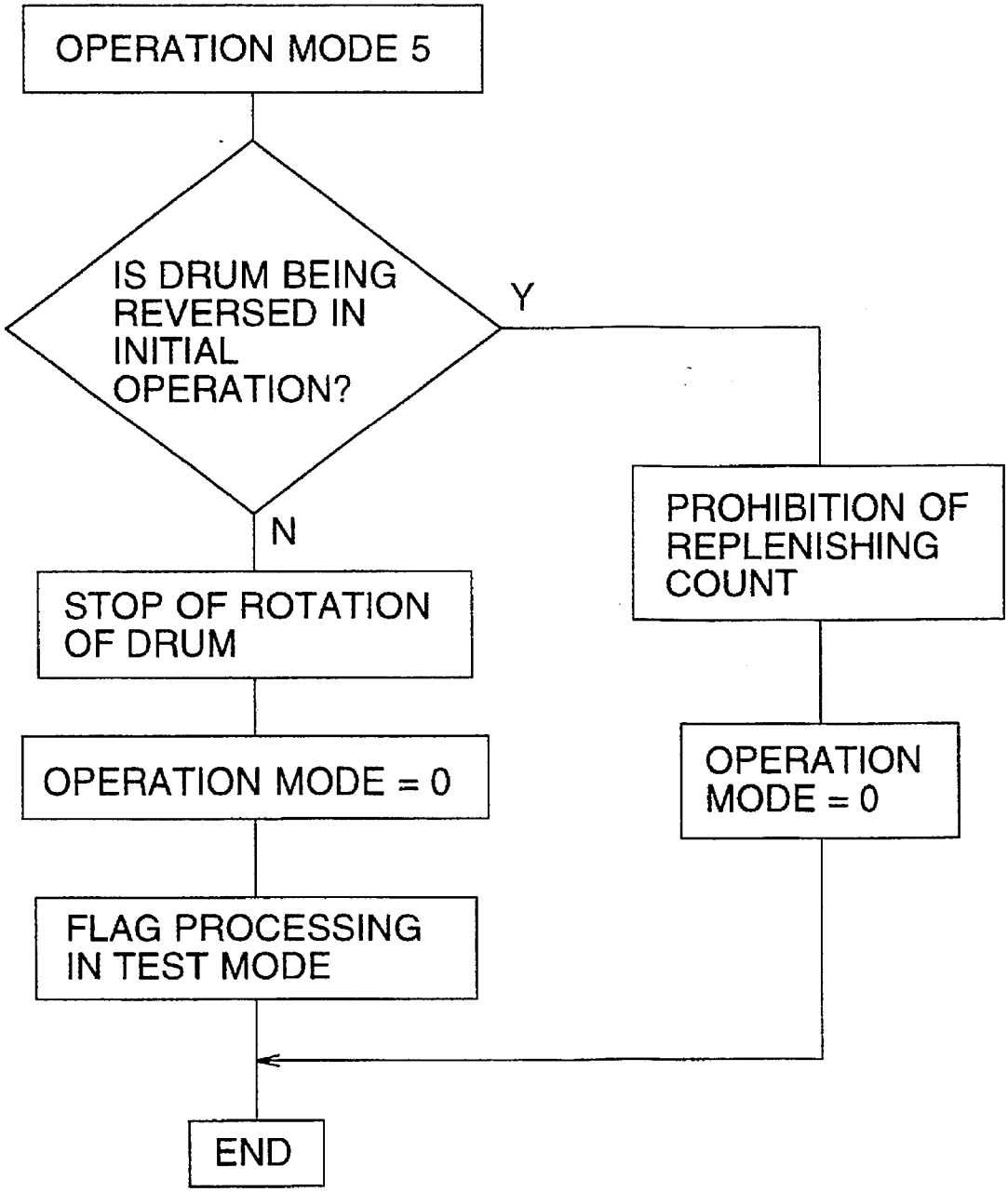
FIG. 10 is a flow of replenishment control (operation mode 5).

FIG. 8 is a replenishment control flow in which abnormal dropping of tablets of the operation mode 3 is checked. FIG. 9 is a replenishment control flow in which the origin detection check of the operation mode 4 is conducted. FIG. 10 is a replenishment control flow in which the initial operation check of the operation mode 5 is conducted. In the operation mode 5, in the case where the manual replenishment switch is pressed, and also when the conveyance drum for charging the solid processing agent is not located at the origin (home position), the conveyance drum is returned to the origin, and then the replenishment operation is conducted. In the operation mode 5, the operation for returning the conveyance drum to the origin is conducted. In the operation mode 5, the conveyance drum is stopped at the origin in the normal replenishment operation.

Table 1 shows the number of cartridges for each kit of the processing agent charged into the processing tanks P1, P2, P3 and also shows the number of solid processing agents. In this example, one box composes one kit.

TABLE 1

| Item | Processing tank P1 | P2 | P3 |
|---|---|---|---|
| ① J cartridge | 4 rows × 10 tablets | 4 rows × 10 tablets | 1 row × 10 tablets |
| ② J package (cartridge/box) | 4 | 10 | 2 |
| ③ J charging (tablet/time) | 2 | 2 | 1 |
| ④ Kit unit (tablet) | 160 | 400 | 20 |
| ⑤ Critical value of J charging | 4 | 12 | 6 |

Figure 11:
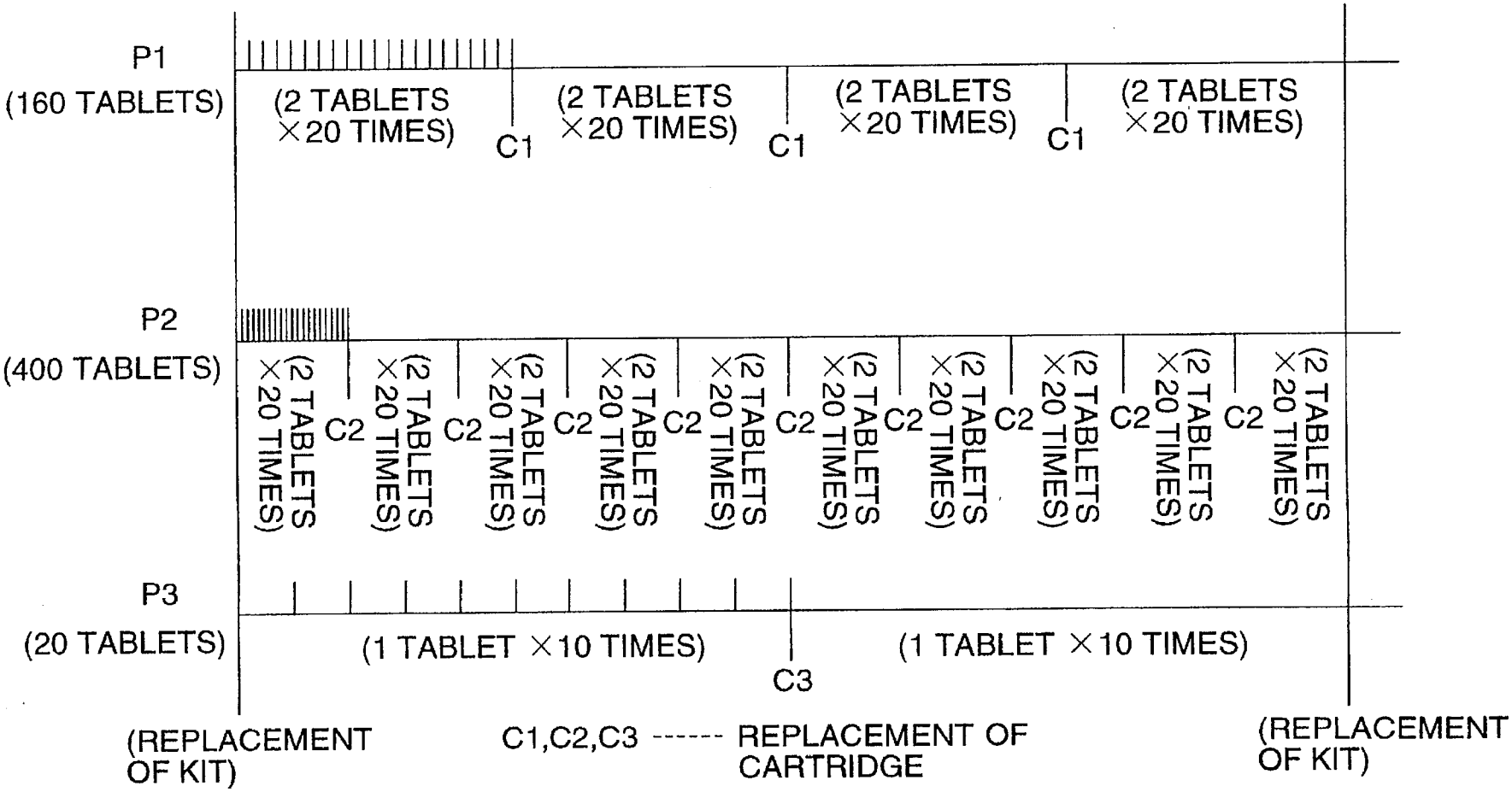
FIG. 11 is a chart showing the essential cyclic operation of replacing the cartridge and kit.

Cartridges JP1, JP2, JP3 were respectively attached to the charging units 10 mounted on the processing tanks P1, P2, P3. Under the above condition, tablets were charged into the processing tanks. FIG. 11 shows the replacement of the cartridges and kits in one cycle under the aforementioned reference condition, wherein the horizontal axis expresses the throughput of light-sensitive material.

As illustrated in FIG. 11, in the normal replenishment control operation for replenishing a solid processing agent, the solid processing agent in each container is simultaneously consumed at the time of replacement of the kit, and at the same time, the kit is replaced. That is, an amount of each solid processing agent is controlled so that the operation of one cycle can be executed by one kit.

Originally, the kit is constructed in such a manner that the processing agents in all cartridges are simultaneously consumed.

However, in some cases, the processing agent clogs in the middle of the replenishment of the solid processing agent, and the stored number of the processing agents in a kit is changed, so that each processing agent is not simultaneously consumed. The first, second and third embodiments of the present invention are characterized in controlling the charge of tablets and supply of water in the aforementioned case.

EXAMPLE 1

In the processing apparatus of light-sensitive material of this example, each time the kit is replaced, the number of tablets (160, 400, 20) to be charged into the processing tanks (P1, P2, P3) is newly inputted into the memory 23. Also, the number of the cartridges (4, 10, 2) to be replaced in one kit is inputted into the memory 23. These numbers are automatically inputted in accordance with the detection conducted by the sensor S3, wherein the sensor S3 detects the type of processing agent and the kit. Of course, these numbers may be manually inputted. An amount of the solid processing agent to be replenished for development, that is, the number of tablets (2, 2, 1) to be charged in one operation, and the number of replenishing operations are also stored in the memory 23, and the light-sensitive material is subjected to development in accordance with the processing program inputted into the memory 23.

Each time tablets are charged into each processing tank, the number of charged tablets is counted by the sensor S1. In the computing section 22, the number of tablets in each kit accessed from the memory 23, or the number of tablets in each cartridge is subtracted, and also the not-replenished amount of the not-replenished detection means is subtracted, so that the residual number of tablets for each kit or cartridge can be computed. The number of tablets obtained when the number of actually used tablets is subtracted from the number of tablets in each processing tank necessary for processing a predetermined amount of light-sensitive material, agrees with the number of tablets remaining in the kit in the normal operation. Therefore, at a point of time when the predetermined amount of light-sensitive material has been processed, no tablets are left in each processing tank. Under this condition, each kit is replaced. The kit replacement prediction is displayed in the display section 24 immediately before the completion of the kit and at a point of time when the residual number of tablets in each processing tank is reduced not more than a predetermined value. At a point of time when the number of residual tablets becomes 0, a kit replacement request is displayed in the display section 24. The kit replacement request may displayed by means of voice or a lamp.

The processing apparatus of light-sensitive material of this example includes: the sensor S1 for detecting an amount of replenishment of the solid processing agent replenished to each processing tank; and a not-replenished amount detection means for detecting the not-replenished amount of the solid processing agent that has not been charged.

Then, the residual amount of the solid processing agent is detected by: an amount of the solid progessing agent for each kit stored in the memory section 23; an amount of replenishment of the solid processing agent outputted from the sensor S1; and a not-replenished amount outputted from the not-replenished amount detection means. In the case where a certain type solid processing agent to be replenished to a processing tank has been consumed for some reason, for example, for the reason of a mechanical breakdown, the solid processing agent remains in other processing tanks. The solid processing agent remaining under the aforementioned condition is referred to as a surplus solid processing agent.

Figure 12:
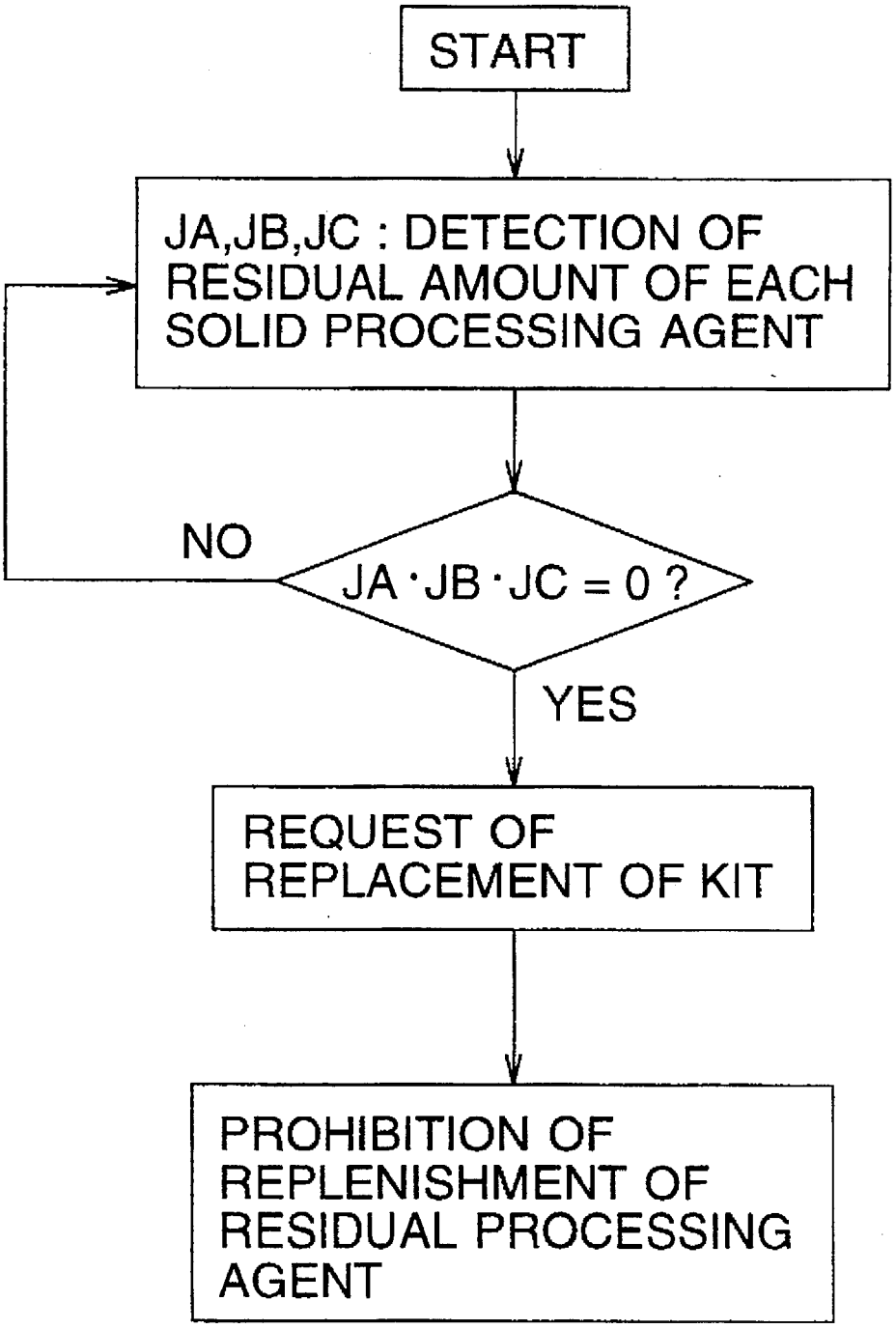
FIG. 12 is a control flow chart of the first embodiment.

In the processing apparatus of light-sensitive material of the present invention, the processing agent residual amount detection is conducted always or periodically in accordance with the processing operation of light-sensitive material. Therefore, the residual amounts JA, JB, JC of the solid processing agent for each kit in each processing tank are monitored by the main control section 20. FIG. 12 shows a control flow of the first example. When either of the residual amounts JA, JB, JC for each kit has been used up, that is, when the expression JA·JB·JC=0 is satisfied, a kit replacement request is displayed in the display section 24. In this connection, the kit replacement request is defined as a request by which the cartridge in each processing tank is requested so as to be replaced with a cartridge of a new kit.

In this case, a preferred embodiment as follows: At a point of time when the residual amount of the solid processing agent for a kit has become 0 in one of the processing tanks, the charge of the surplus solid processing agent into the processing tank is prohibited. More preferably, at a point of time when a short period of time has passed after the residual amount became 0, the charge of the surplus solid processing agent into the processing tank is prohibited.

Due to the foregoing, under the condition of the same processing capacity, each processing tank is subjected to kit replacement. Therefore, the disturbance among lots can be avoided. When the kit is replaced with a new one, prohibition of the charge of the processing agent is cleared, and data of a new kit is inputted or data is renewed. In accordance with the data, processing control is executed. Concerning water supply, an area of light-sensitive material to be processed is used as a reference, and water is individually supplied to each processing tank in accordance with the amount of charged solid processing agent.

EXAMPLE 2

In the processing apparatus of light-sensitive material of this example, each time the kit is replaced, the numbers of tablets (160,400, 20) to be charged into the processing tanks (P1, P2, P3) are newly inputted into the memory 23. Also, the number of cartridges (4, 10, 2) to be replaced in one kit is inputted into the memory 23. These inputting operations are automatically conducted in accordance with the result of detection of the processing agent and the kit, wherein the detection is executed by the sensor S3. Of course, these inputting operations may be manually conducted. An amount of replenishment of the solid processing agent for developing a predetermined amount of light-sensitive material, that is, the number of tablets (2, 2, 1) to be charged in one charging operation and the number of replenishment are also inputted into the memory 23, and the light-sensitive material is developed in accordance with the processing program inputted into the memory 23.

Each time tablets are charged into each processing tank, the number of charged tablets is counted by the sensor S1. In the computing section 22, the number of tablets in each kit accessed from the memory 23, or the number of tablets in each cartridge is subtracted, and also the not-replenished amount of the not-replenished detection means is subtracted, so that the residual number of tablets for each kit or cartridge can be computed. The number of tablets obtained when the number of actually used tablets is subtracted from the number of tablets in each processing tank necessary for processing a predetermined amount of light-sensitive material, agrees with the number of tablets remaining in the kit in the normal operation. Therefore, at a point of time when the predetermined amount of light-sensitive material has been processed, no tablets are left in each processing tank. Under this condition, each kit is replaced. The kit replacement prediction is displayed in the display section 24 immediately before the completion of the kit and at a point of time when the residual number of tablets in each processing tank is reduced not more than a predetermined value. At a point of time when the number of residual tablets becomes 0, a kit replacement request is displayed in the display section 24. The kit replacement request may displayed by means of voice or a lamp.

The processing apparatus of light-sensitive material of this example includes: the sensor S1 for detecting an amount of replenishment of the solid processing agent replenished to each processing tank; and a not-replenished amount detection means for detecting the not-replenished amount of the solid processing agent that has not been charged. Then, the residual amount of the solid processing agent is detected by: an amount of the solid processing agent for each kit stored in the memory section 23; an amount of replenishment of the solid processing agent outputted from the sensor S1; and a not-replenished amount outputted from the not-replenished amount detection means. In the case where a certain type solid processing agent to be replenished to a processing tank has been consumed for some reason, for example, for the reason of a mechanical breakdown, the solid processing agent remains in other processing tanks. The solid processing agent remaining under the aforementioned condition is referred to as a surplus solid processing agent.

Figure 13:
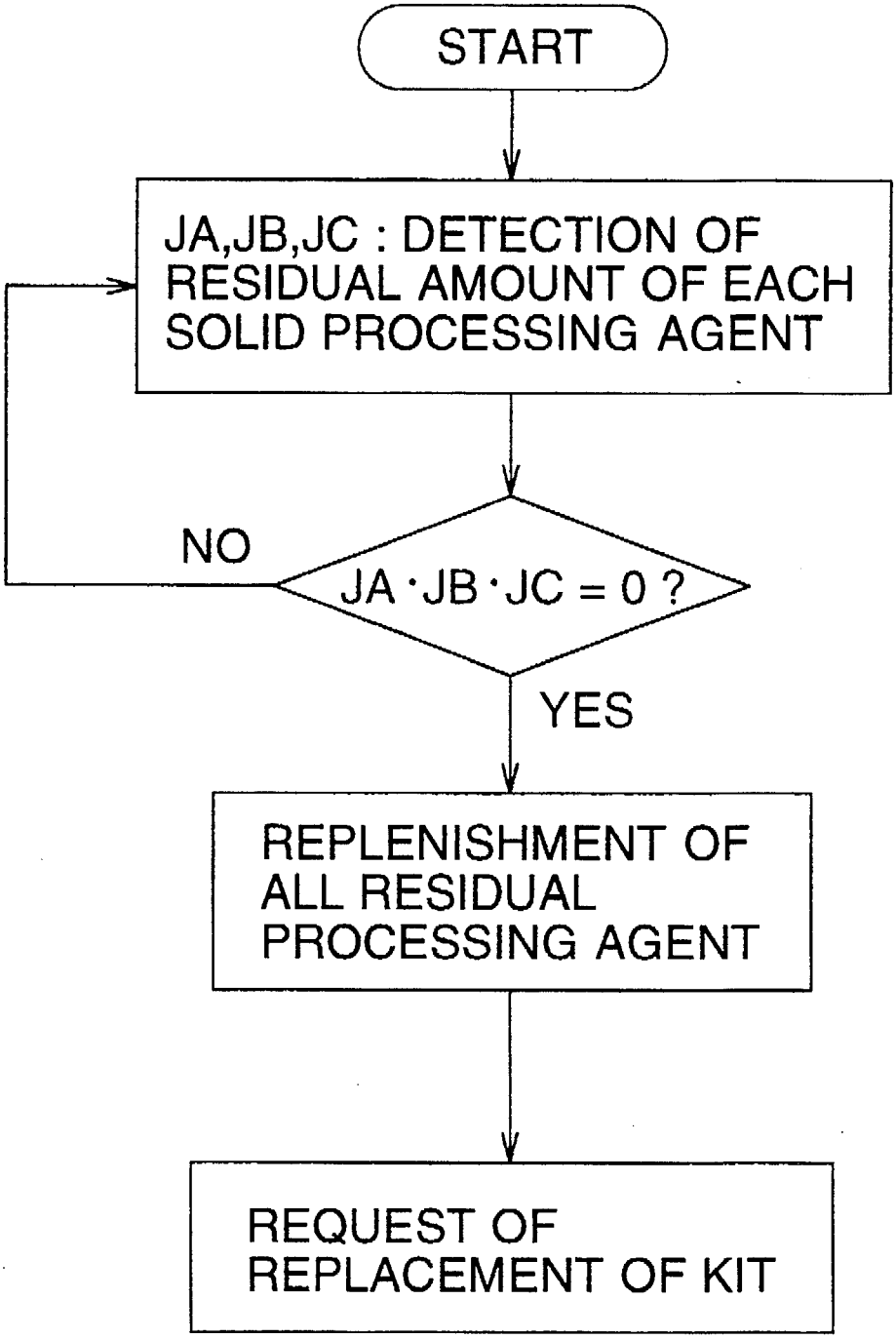
FIG. 13 is a control flow chart of the second embodiment.

In the processing apparatus of light-sensitive material of the present invention, the processing agent residual amount detection is conducted always or periodically in accordance with the processing operation of light-sensitive material. Therefore, the residual amounts JA, JB, JC of the solid processing agent for each kit in each processing tank are monitored by the main control section 20. FIG. 13 shows a control flow of the second example. When either of the residual amounts JA, JB, JC for each kit has been used up, that is, when the expression JA·JB·JC=0 is satisfied, all the surplus solid processing agents are forcibly charged into the respective processing tanks. Of course, some time intervals are allowed in this charging operation.

The display of request for replacing a kit is made after all the surplus solid processing agents have been charged into the processing tanks. Due to the foregoing, all the solid processing agents for each kit are replenished except for the not-replenished processing agent. Therefore, all cartridges become empty, so that the used kits can be replaced with new kits.

In the processing apparatus of light-sensitive material of this example, the number of water supplying operations is computed for each processing tank each time the kit is replaced, and water is supplied in accordance with the result of the computation. In accordance with the water supplying operations, the number of the water supplying operations is counted so that water is supplied in accordance with the result of the computation. At this time, the water supplying operation is conducted for each processing tank. While consideration is given to the fluctuation of concentration of the processing solution, water is supplied by slow degrees. For example, the divided water supplying operation is shown in the following Table 2, and an amount of water for one replenishing operation is supplied each minute.

TABLE 2

| Item | | P1 | P2 | P3 | Remark |
|---|---|---|---|---|---|
| Amount of fundamental water supply | A6 | 62 | 89.5 | 180 | $ml/m^2$ |
| | A5/A3 | 66.3 | 95.8 | 249 | $ml/m^2$ |
| Amount of processing by fundamental operation | A6 | 2.72 | 1.088 | 10.88 | $m^2$/time |
| | A5/A3 | 2.54 | 1.016 | 10.17 | $m^2$/time |
| Amount of water supply for each time | A6 | 168.6 | 97.4 | 1958.4 | ml/time |
| | A5/A3 | 168.4 | 97.3 | 2532.3 | ml/time |

Amount of water supply by one replenishment operation is found by the following expression.

(Water supply)=(Amount of fundamental water supply)×(Amount of processing of fundamental operation)

The water supplying operation described above is different from the common water supplying operation conducted in development processing. This water supplying operation is explained as follows: Water is supplied in the development processing in accordance with an area of the paper to be processed, however, when the kit is replaced, water is supplied to each processing tank in accordance with an amount of the surplus processing agent in each tank.

EXAMPLE 3

In the processing apparatus of light-sensitive material of this example, each time the kit is replaced, the number of tablets (160, 400, 20) to be charged into each processing tank (P1, P2, P3) is newly inputted into the memory 23. The number of cartridges (4, 10, 2) to be replaced in one kit is also inputted into the memory 23. Further in this example, the critical value of charging delay (4, 12, 6) for each processing tank, which will be explained later, is also inputted into the memory 23. These inputting operations are automatically conducted in accordance with the detection of the type of processing agent and the kit made by the sensor S3. Of course, these inputting operations may be manually conducted. An amount of replenishment of the solid processing agent for developing a predetermined amount of light-sensitive material, that is, the number of tablets (2, 2, 1) to be charged in one charging operation and the number of replenishment are also inputted into the memory 23, and the light-sensitive material is developed in accordance with the processing program inputted into the memory 23.

Each time tablets are charged into each processing tank, the number of charged tablets is counted by the sensor S1. In the computing section 22, the number of tablets in each kit accessed from the memory 23, or the number of tablets in each cartridge is subtracted, and also the not-replenished amount of the not-replenished detection means is subtracted, so that the residual number of tablets for each kit or cartridge can be computed.

The number of tablets obtained when the number of actually used tablets is subtracted from the number of tablets in each processing tank necessary for processing a predetermined amount of light-sensitive material, agrees with the number of tablets remaining in the kit in the normal operation. Therefore, at a point of time when the predetermined amount of light-sensitive material has been processed, no tablets are left in each processing tank. Under this condition, each kit is replaced. The kit replacement prediction is displayed in the display section 24 immediately before the completion of the kit and at a point of time when the residual number of tablets in each processing tank is reduced not more than a predetermined value. At a point of time when the number of residual tablets becomes 0, a kit replacement request is displayed in the display section 24. The kit replacement request may displayed by means of voice or a lamp.

The processing apparatus of light-sensitive material of this example includes: the sensor S1 for detecting an amount of replenishment of the solid processing agent replenished to each processing tank; and a not-replenished amount detection means for detecting the not-replenished amount of the solid processing agent that has not been charged. Then, the residual amount of the solid processing agent is detected by: an amount of the solid processing agent for each kit stored in the memory section 23; an amount of replenishment of the solid processing agent outputted from the sensor S1; and a not-replenished amount outputted from the not-replenished amount detection means. When a certain type solid processing agent to be replenished to a processing tank has been consumed for some reason, for example, for the reason of a mechanical breakdown, the solid processing agent remains in other processing tanks. The solid processing agent remaining under the aforementioned condition is referred to as a surplus solid processing agent.

Figure 14:
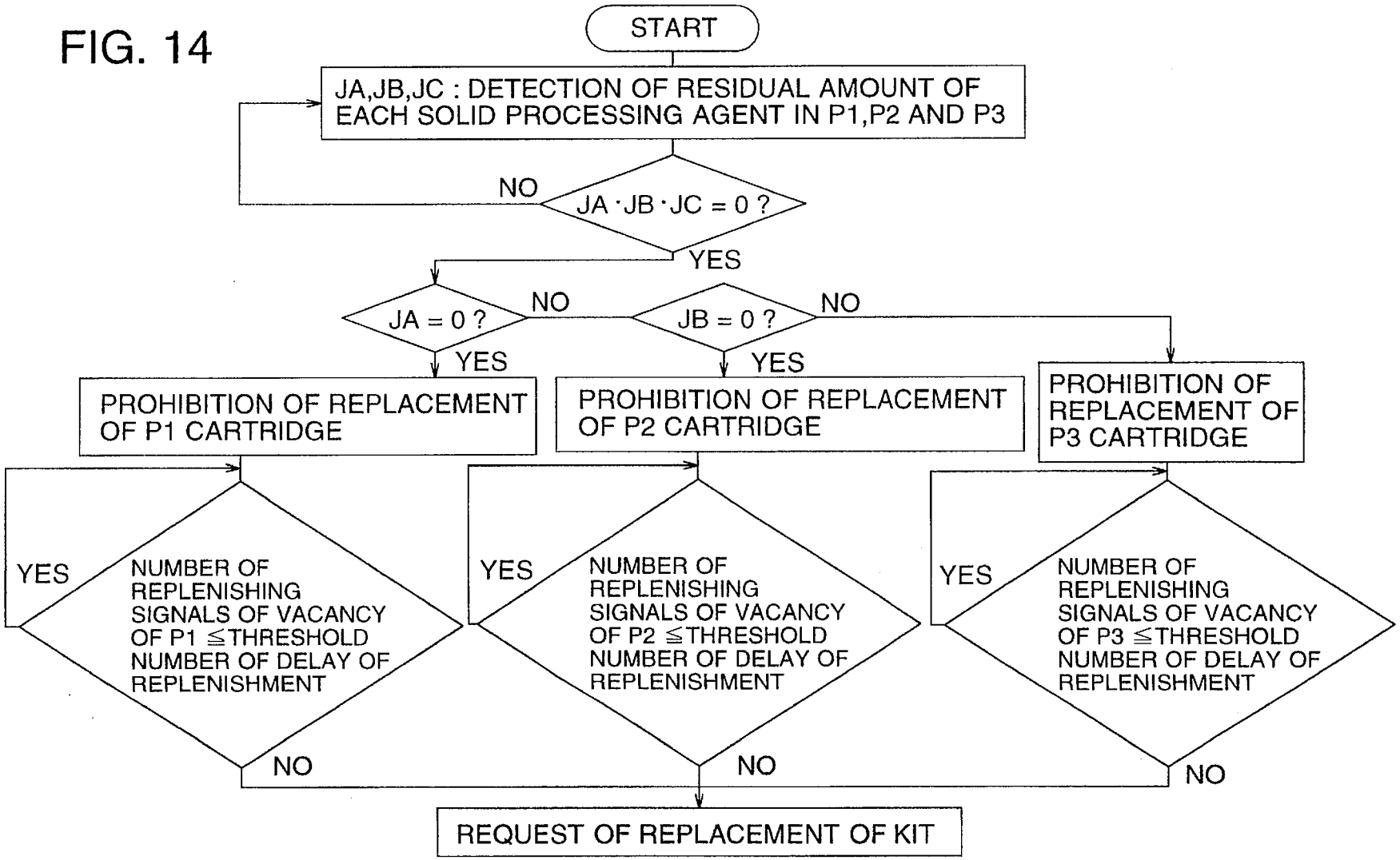
FIG. 14 is a control flow chart of the third embodiment.

In the processing apparatus of light-sensitive material of the present invention of the processing agent residual amount detection is conducted always or periodically in accordance with the processing operation of light-sensitive material. Therefore the residual amounts JA, JB, JC of the solid processing agent for each kit in each processing tank are monitored by the main control section 20. FIG. 14 shows a control flow of the third example. When either of the residual amounts JA, JB, JC for each kit has been used up, that is, when the expression JA·JB·JC=0 is satisfied, it is found whether or not JA=0 in the tank P1, and also it is found whether or not JB=0 in the tank P2, and also it is found whether or not JC=0 in the tank P3. For example, when the residual amount JB is 0 in the tank P2, the replenishment delay critical value 12 of the tank P2 is accessed from the memory 23. In this case, the replenishment delay critical number is defined as a critical frequency in which the processing characteristics are not greatly deteriorated even when vacant replenishing operations are repeated, wherein the vacant replenishing operation is a charging operation of the charging unit 10 by which the solid processing agent is not substantially charged. Even when the residual amount JB becomes 0 in the tank P2, the supply of the solid processing agent is continued.

Until the vacant replenishing signal number, which is the number of signals of the replenishing operations in which the solid processing agent is not charged into the tank P2, reaches the replenishing delay critical number 12, the surplus solid processing is charged into other processing tanks. At a point of time when the vacant replenishing signal number has reaches the replenishing delay critical number 12, a request of kit replacement is displayed in the display section 24. It is a preferred embodiment that: after a no-solid processing agent signal was generated, the cartridge of the tank P2 is prohibited from being replaced until the request of the kit replacement is made. After the kit has been replaced, this prohibiting operation is cleared. Alternatively this prohibiting operation is cleared by a check operation conducted by the operator.

In this example, when the residual amount of the solid processing agent in one of the light-sensitive material processing tanks has become 0 and the surplus solid processing agent exists in other processing tanks, the replenishing operation is continued in a guaranteed range of the processing agent. Therefore, this example is effective in delaying the kit replacement which requires a large amount of labor.

In the above description, an example is disclosed, in which it is judged by making a comparison between the number of vacant replenishing operations and the threshold value whether or not it has reached the critical point of delay of replenishing the processing agent. However, an essential point of the invention is to realize the critical point of delay of replenishing the processing agent by making a comparison between an amount of light-sensitive material processed while the processing agent is not charged although the processing agent must be charged, and an amount of light-sensitive material allowed to be processed under the condition that the processing agent is not charged.

In the light-sensitive material of this example, the frequency of water supply operations is computed each time the kit is replaced, and water is supplied according to the frequency. When water is supplied, the frequency is counted. At the time of completion of a kit, water is supplied according to a difference between the required water supply frequency and the counted water supply frequency. At this time, the water supply operation is conducted for each processing tank, and water is gradually supplied while consideration is given to the fluctuation of concentration of the processing solution. For example, the gradual water supply operation is shown in Table 2, in which an amount of replenishment in one operation is fed each minute.

EXAMPLE 4

The light-sensitive material processing apparatus of this example includes: a replenishment control means for controlling an amount of the solid processing agent so that a predetermined amount of the solid processing agent can be replenished in accordance with the processing of a predetermined amount of light-sensitive material; a ratio correcting means for correcting a ratio of the throughput of the light-sensitive material processed by the automatic developing apparatus, to the amount of replenishment of the solid processing agent to be replenished into the processing tank. This ratio correcting means is defined as a means for computing a ratio of the replenishment amount of the solid processing agent to be replenished to the processing tank for the throughput of the light-sensitive material to be processed, wherein the residual amount of the solid processing agent in one kit, and the residual amount of the light-sensitive material to be processed are used in this computation. It is preferable that the aforementioned ratio correcting means includes a threshold value changing means for changing the throughput of light-sensitive material which is a threshold value for replenishment conducted by the replenishment controlling means. In accordance with the threshold value changed by the threshold value changing means described above, the replenishment control means replenishes the solid processing agent. A specific example is described as follows: Before the change of the operation, each time the throughput of light-sensitive material reached 100 $m^2$, 4 tablets of the solid processing agent were charged. After the change of the operation, each time the throughput of light-sensitive material reaches 80 $m^2$, 4 tablets of the solid processing agent are charged, or alternatively each time the throughput of light-sensitive material reaches 120 $m^2$, 4 tablets of the solid processing agent are charged. As a result, charging intervals of the solid processing agent are changed. In this specification, the charging interval does not represent the time interval, but it represents the throughput of light-sensitive material of the automatic developing apparatus. The threshold value changing means computes the threshold value from the residual amount of the solid processing agent in one kit and also from the throughput of light-sensitive material to be processed by one kit.

Figure 15:
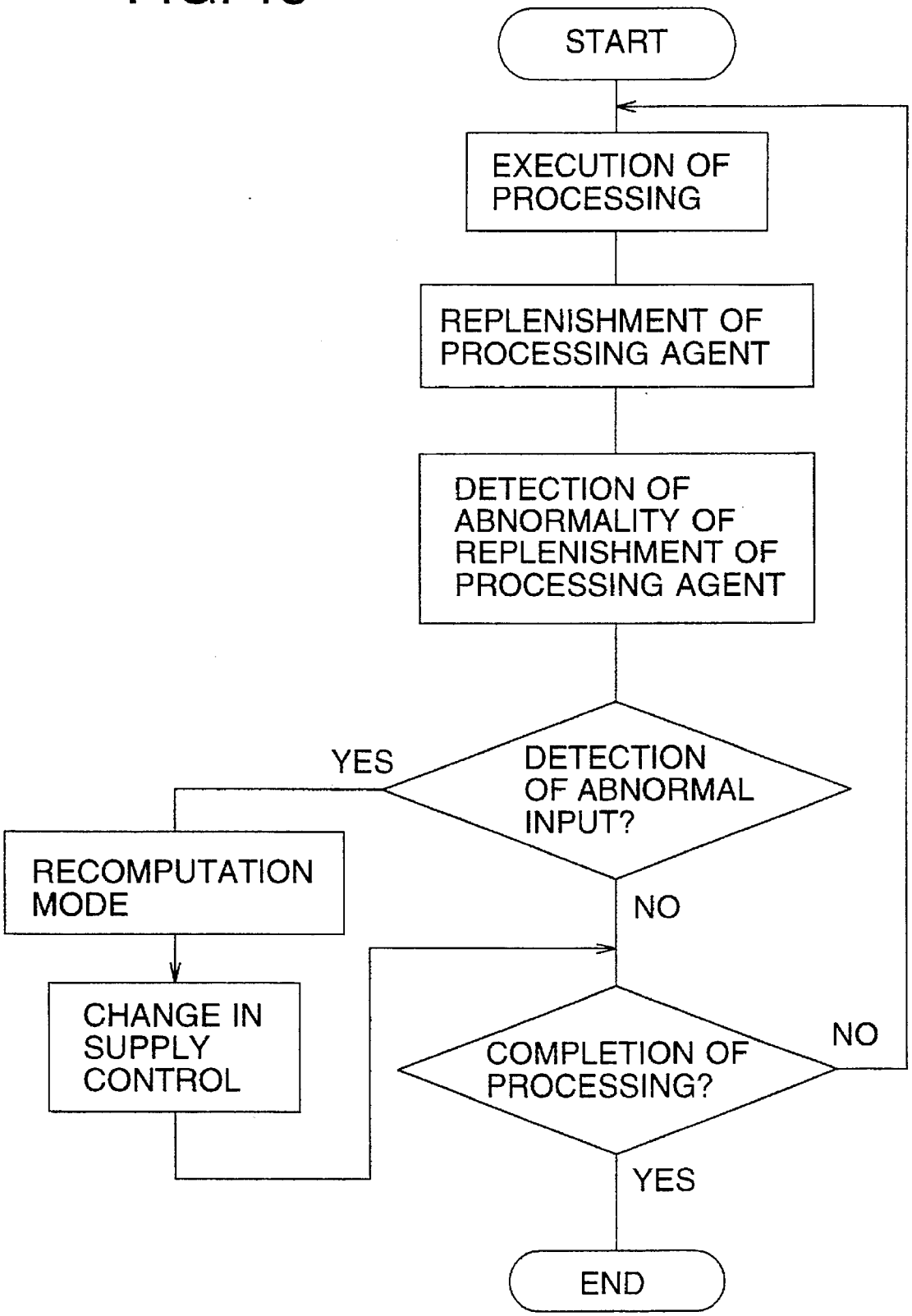
FIG. 15 is a control flow chart of the fourth embodiment.
Figure 16:
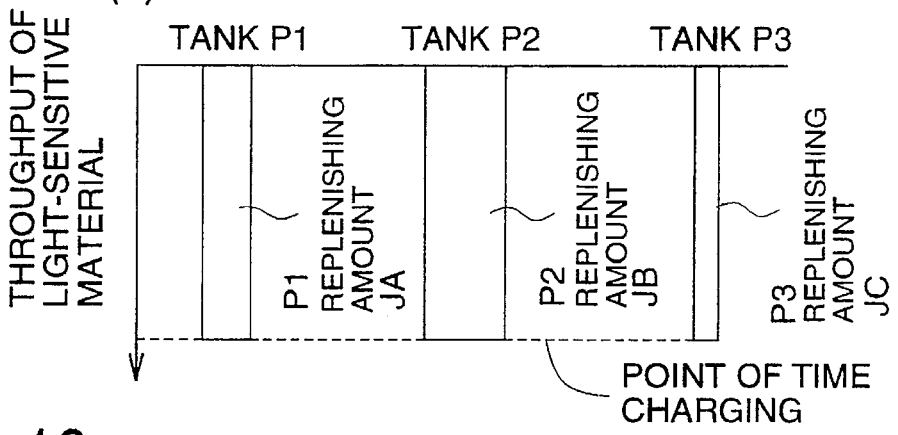
FIGS. 16(*a*) to 16(*d*) are schematic illustrations for explaining the computation conducted in the fourth embodiment.
Figure 16:
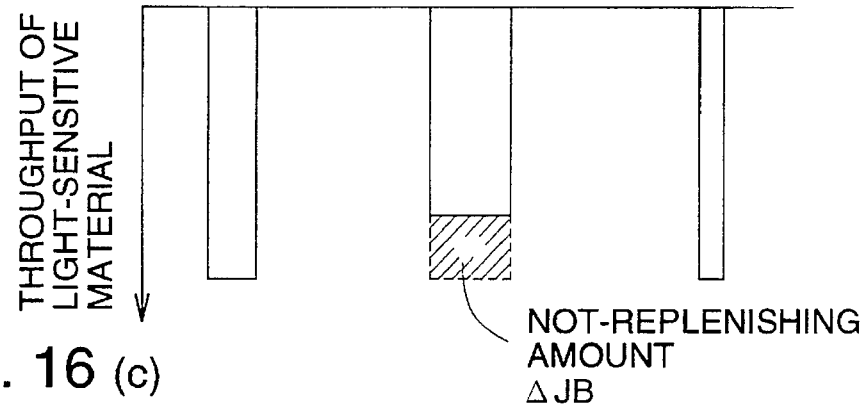
Figure 16:
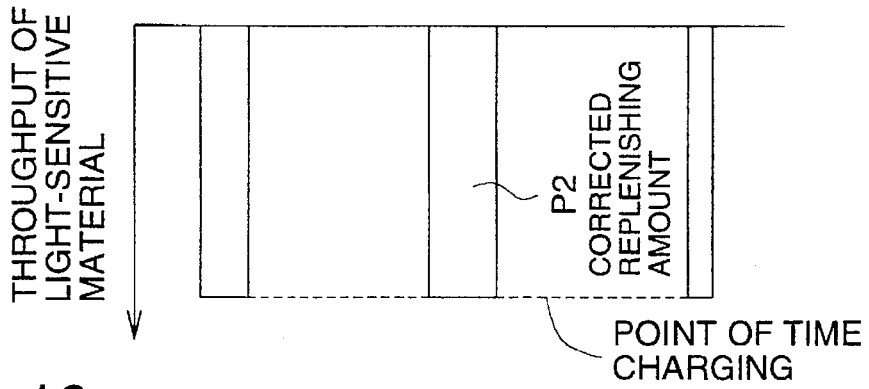
Figure 16:
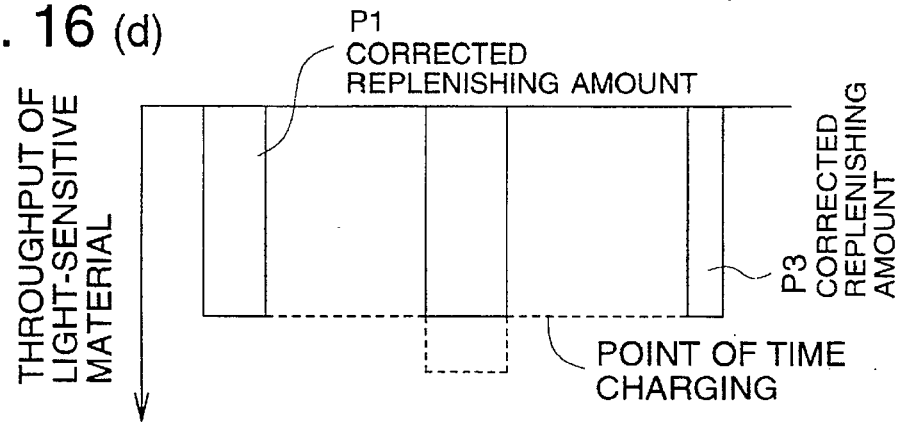

FIG. 15 is a flow chart of the fourth example, and FIG. 16 is a schematic illustration showing a condition in which an amount of the solid processing agent is corrected by the present invention.

As described above, an amount of the solid processing agent required for processing a predetermined amount of light-sensitive material is previously determined for each processing tank. Therefore, each solid processing agent required for processing the predetermined amount of light-sensitive material is provided to form a kit. Therefore, supply of the solid processing agent is controlled in the formed of a kit. As illustrated in FIG. 11, in the case where a normal developing operation is conducted, each solid processing agent is supplied to each processing tank in accordance with the throughput of light-sensitive material. Accordingly, the residual amount of the solid processing agent in each processing tank is approximately simultaneously reduced to 0, and each kit is replaced. This operation is explained in FIG. 16(*a*).

When the operation is normally conducted, a point of time at which the charge of the solid processing agent has been completed becomes approximately the same with respect to the tanks P1, P2 and P3. To be more accurately, a point of time at which the processing of the solid processing agent has been completed and the charge is newly started, becomes approximately the same with respect to the tanks P1, P2 and P3.

FIG. 16(*b*) shows a replenishing condition for each processing tank in which a not-replenishing amount is caused in a specific processing tank (in this case, the tank P2).

In the present invention, the not-replenishing amount detecting means detects the abnormal replenishment of the solid processing agent. Alternatively, the not-replenishing amount ΔJB is detected by a manual inputting operation through the operating section 21. At this time, the operation mode is immediately changed to the recomputation mode, and the computing section 22 conducts computation in accordance with the previously determined program and the residual amounts of (JA), (JB−ΔJB) and (JC) at the point of time of recomputation. In this way, the program is switched to a newly corrected replenishing program.

The not-replenishing amount detection means is operated in the case where a value obtained when an amount of the solid processing agent used for processing light-sensitive material is subtracted from an amount of the solid processing agent required for processing a predetermined amount of light-sensitive material, is different from an amount of solid processing agent corresponding to the processing of the residual light-sensitive material. When the not-replenishing amount detection means is operated, the correction control means is controlled so as to be operated.

FIGS. 16(*c*) and 16(*d*) show an example of the above circumstances. In the control shown in FIG. 16(*c*), even when a not-replenishing amount is caused in the processing agent amount for each kit necessary for the processing of a predetermined amount of light-sensitive material, the predetermined amount of light-sensitive material is processed by the residual solid processing agent. Recomputation is conducted in the above manner. For example, it is assumed that the processing ability of the solid processing agent with respect to a predetermined amount of light-sensitive material in the tank P2 is increased to JB/(JB−ΔJB), and then the timed relation of replenishing the solid processing agent to the tank P2 is corrected in the following manner: The interval of charging the solid processing agent is extended to be {JB/(ΔJB−JB)}, and the control of charging the solid processing agent to other processing tanks is not changed. Then the computation is conducted so that the residual amount of the solid processing agent in each processing tank becomes 0 at a point of time when the normal charging operation has been completed as shown in FIG. 16(*a*). In the manner described above, replenishing control of the solid processing agent is conducted.

The computation with respect to the tank P2 is changed by the threshold value changing means in the following manner: For example, before the change, 4 tablets of the solid processing agent were charged each time the throughput of light-sensitive material reached 100 $m^2$. After the change, 4 tablets of the solid processing agent are charged each time the throughput of light-sensitive material reaches 120 $m^2$.

In accordance with the change described above, control for charging the solid processing agent is conducted by the replenishing control means, and the replenishing interval of the tank P2 is changed so as to be extended. As a result, the solid processing agents in all the processing tanks are simultaneously consumed.

The control shown in FIG. 16(*d*) will be described as follows:

In the case where a not-replenishing amount (ΔJB) is caused in the processing agent for each kit necessary for the processing of a predetermined amount of light-sensitive material, the throughput of light-sensitive material corresponding to the not-replenishing amount of the processing agent is subtracted from the predetermined amount, that is, the control is shown by the expression of {(JB−ΔJB)/JB}. In this way, the recomputation is conducted. In this case, the charging intervals of the solid processing agent of the tanks P1, P3 in which the not-replenishing amount is not caused, are respectively corrected to be {(JB−ΔJB)/JB}. In this case, charging of the solid processing agent is completed earlier than the normal charging operation illustrated in FIG. 16(*a*), that is, (JB)t is changed to (JB−ΔJB)t.

The computations with respect to the tanks P1 and P3 are changed by the threshold value changing means in the following manner:

For example, before the change, 4 tablets of the solid processing agent were charged each time the throughput of light-sensitive material reached 100 $m^2$. After the change, 4 tablets of the solid processing agent are charged each time the throughput of light-sensitive material reaches 80 $m^2$.

In accordance with the change described above, control for charging the solid processing agent is conducted by the replenishing control means, and the replenishing intervals of the tanks P1 and P3 are changed so as to be shortened. As a result, the solid processing agents in all the processing tanks are simultaneously consumed.

FIGS. 16(*c*) and 16(*d*) shows extreme examples of recomputation, which will be described as follows. FIG. 16(*c*) shows an example in which: recomputation is immediately conducted when a not-replenishing amount is recognized; and it is assumed that the processing ability of the solid processing agent is increased, and a predetermined amount of light-sensitive material is processed. FIG. 16(*d*) shows an example in which: an amount of light-sensitive material to be processed is reduced in accordance with the not-replenishing amount. In accordance with the result of the computation, the replenishing amount of the solid processing agent is corrected. In this case, the recomputation conducted here is not limited to (c) and (d) described above, and it is possible to correct the replenishing amount of the solid processing agent in the manner between (c) and (d). Especially, it is possible to conduct the computation by changing the program in accordance with a processing tank in which the not-replenishing amount has been caused. As described above, immediately after the detection of the not-replenishing amount, the recomputation is conducted, and the charging control of the solid processing agent is corrected in accordance with the result of the recomputation. Except for the above controlling method, the following control methods may be adopted:

Detection of the not-replenishing amount is conducted not every hour, but conducted at regular intervals (for example, every day). Even when the not-replenishing amount is detected, in the case where the difference is not more than a predetermined amount, recomputation is not conducted immediately, and the difference is monitored until it becomes a predetermined value.

Even after the recomputation has been conducted, it is possible not to change over the control immediately but to wait for a predetermined period of time. When the recomputation is conducted at regular intervals, various data of other processing tanks may be added so as to control the entire apparatus. In this case, an amount of the solid processing agent including a developing component is preferably corrected so that the fluctuation of concentration can be avoided. The reason why is that high accuracy is required for the solid processing agent including a developing component compared with other solid processing agents. In other words, according to the processing agent in which a not-replenishing amount has been caused, control may be changed.

When an amount of the solid processing agent including a developing component is corrected, using an amount of light-sensitive material processed by the corrected amount of the solid processing agent, and also using the residual amounts of other solid processing agents, an amount of light-sensitive material to be processed by other solid processing agents is preferably corrected. When the control of a developing solution is given priority because it has great influence on quality, the supply control of the solid processing agent is essential. Therefore, when this value is changed and correction is made in accordance with the change, it is preferable that the charging control of other solid processing agents is preferably corrected.

On the contrary, when a not-replenishing amount is caused in other processing agents except for the developing agent, the following control may be conducted:

For example, controlling operation is conducted in the same manner as described in the third example, and the charging control of development and other processing is not conducted.

Result of the computation conducted in the computing section 22 is sent from the main control section 20 to the development control unit 30, and in accordance with the processing of a predetermined amount of light-sensitive material, the solid processing agent is replenished to each processing tank according to the newly corrected program.

In the light-sensitive material processing apparatus of the present invention of not only in the case where a not-replenishing amount has occurred in the solid processing agent to be charged but also in the case where a kit is replaced with a new one, the aforementioned control can be adopted.

Information necessary for correction conducted according to a change in the processing agent when a kit is changed, is manually inputted in accordance with the specification attached onto a container. In the case where the specification is recorded on a bar code or floppy disk, information is read in, and correction of the processing control program is conducted according to the information. In this case, the light-sensitive material processing apparatus is provided with information reading means including the type detection sensor S3 described before. In accordance with the read information, recomputation is conducted.

Consequently, even when the processing kit is replaced with another one having different characteristics, or even when a not-replenishing amount has occurred, the processing program can be immediately changed over appropriately. Therefore, the apparatus of the present invention is superior to the conventional automatic developing apparatus in the work efficiency and convenience of operation.

In the above example, in one kit, there are provided a plurality of cartridges accommodating the solid processing agent for the same processing tank, however, when the processing agent is improved, it is possible that one cartridge of the same type solid processing agent is provided in one kit. When the processing agent is charged by means of remote control, of course, the same control as described above can be adopted.

It is possible to arrange the operation into modes in order to accomplish the second, third and fourth examples described before, and a means for selecting each mode may be provided in the operating section 21 in FIG. 1. When a signal corresponding to a mode selected by the operating section 21 is inputted into the main control section 20, control can be conducted as described before. It is preferable to adopt a mode in which the second and third examples are combined.

Figure 17:
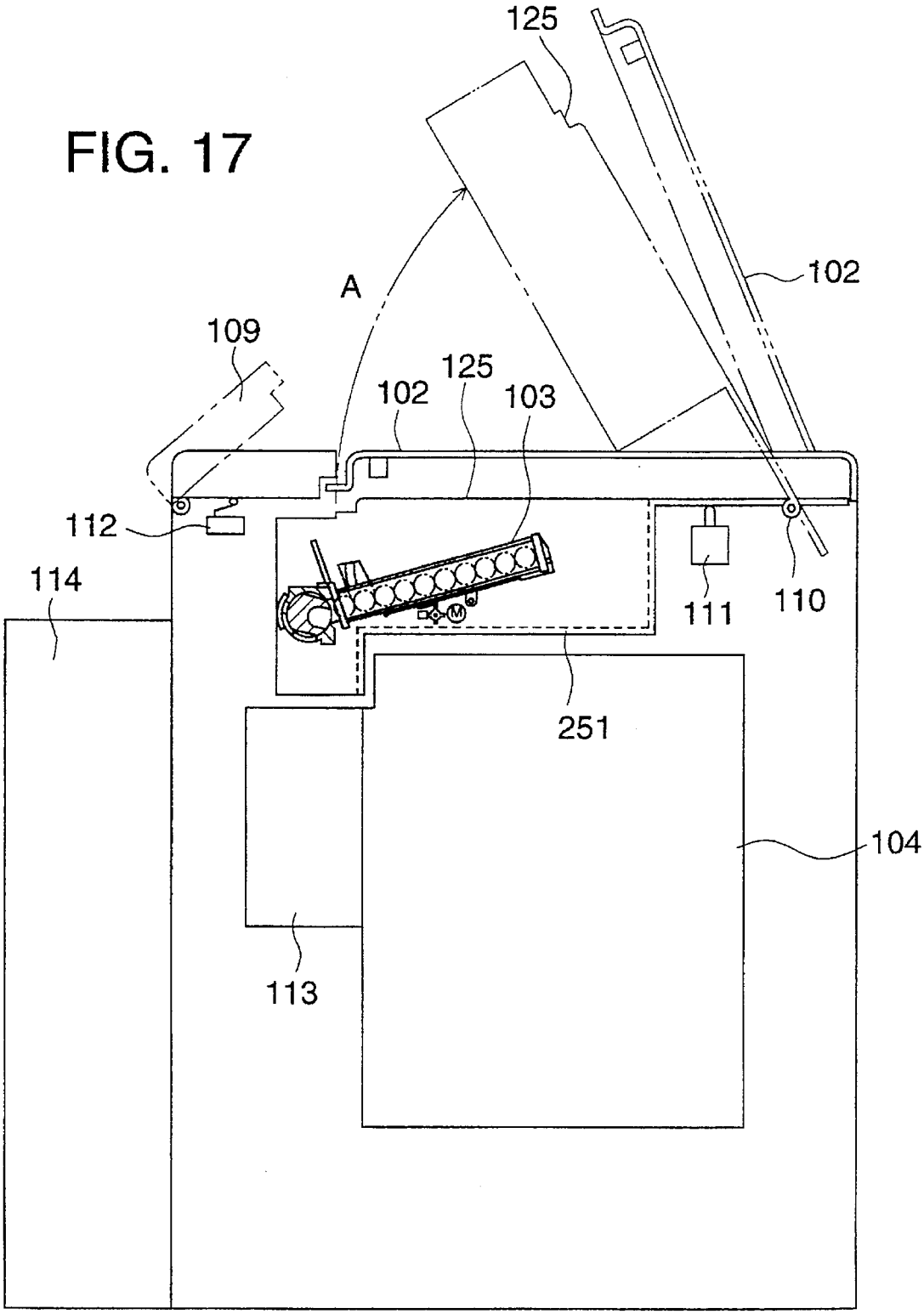
FIG. 17 is a side sectional view showing another example of the processing apparatus of light-sensitive material of the present invention.

FIG. 17 is a side sectional view of the light-sensitive material processing apparatus of the example. After the first cover 102 has been opened, the inner cover 125 having the charging unit 103 is opened upward around the hinge 110, which is illustrated by a two-dotted chain line in FIG. 17. in order to open the first cover 102, the second cover 109 is opened or removed, and the sensor 112 detects this motion. By the detection of the sensor 112, the processing agent charging unit 103 is stopped at a home position. In the case where the processing agent charging unit 103 is operating, a warning sound is given.

The motion of the first cover 102 is detected by the sensor 111, and the power supply is turned off for safety. In the example shown in FIG. 17, a constant temperature bath 113 is provided adjacent to the processing tank 104 including the processing section. The processing agent charging unit 103 is located above the processing tank 104, and a portion of the processing agent charging unit 103 is protruded and located on the constant temperature bath, so that the processing agent is charged into the constant temperature bath 113.

In this example, the cover is not directly locked by a locking member, but the cover is locked when the opening button is fixed. Accordingly, damage of the lock member can be prevented.

A shielding plate 251 is interposed between the inner cover 125 and the processing tank 104. Therefore, moisture of the processing tank 104 is shielded, and deterioration of the solid processing agent can be prevented. In the case where the processing tank 104, constant temperature bath 113 and processing agent charging unit 103 are inspected, the first cover 102 and the second cover 109 are opened, and then the inner cover 125 is raised and shaken in the direction A illustrated by the one-dotted chain line in the drawing, so that the front and the upper portion is opened with respect to an operator. When the apparatus is opened in the above manner, the processing agent charging unit 103 is exposed, so that maintenance can be easily executed. Further, the upper portion of the processing tank 104 is opened, and maintenance and jam clearance can be easily executed.

The present invention is not limited to an apparatus in which a tablet type solid processing agent is used, but the present invention can be applied to an apparatus in which a granule type solid processing agent is used when a specific means for supplying the solid processing agent is changed.

The present invention relates to an automatic developing apparatus in which a tablet type solid processing agent is charged into the processing tank so as to replenish the processing agent, and the kit of the solid processing agent is controlled. Due to the foregoing, the conventional storage control by which the storage of the processing agent is individually controlled, can be improved. According to the first, second and third examples of the present invention, in the case where a surplus processing agent is generated due to an accident, the processing agent can be supplied to the processing tank of the surplus processing agent without affecting the developing operation, so that the apparatus is ready for the next operation. Replenishment of the processing agent is controlled in the above manner. Therefore, while the kits are successively replaced, a predetermined amount of processing agent can be stably maintained in all the processing tanks. In this way, a problem peculiar to the automatic developing apparatus when a tablet type processing agent is used, can be solved. According to the fourth example of the present invention, the following effect can be provided. In the case where the processing agent specification is changed, or a not-replenishing amount is generated and a surplus amount of the processing agent is generated, a computation is conducted so that the tablet charging cycle can be changed, and the replenishing control is conducted in accordance with the result of the computation. Therefore, the replenishing control is conducted for one cycle of the kit replacement. Therefore, even when the specification of the processing agent is changed, a predetermined processing agent condition can be stably maintained for all the processing tanks, following the previous replenishing control. Accordingly, labor can be saved in storage control, and kit control can be successively conducted.

What is claimed is:

1. A processing apparatus for a light-sensitive material, comprising:

(a) a plurality of processing tanks for processing a light-sensitive material (b) a detector for detecting an amount of said light-sensitive material which is actually processed, and for generating a signal when said detected actually processed amount of light-sensitive material reaches a predetermined value;

(c) a kit including a plurality of containers, said containers each being associated with respective processing tanks, and each container accommodating respective different solid processing agent, an amount of said solid processing agents in each of said containers being initially expected to be sufficient for processing a predetermined amount of the light sensitive material in each of said plurality of processing tanks;

(d) a memory for storing a value representing said amount of each of said solid processing agents initially expected to be sufficient for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers and for outputting a used-up signal when it is detected that a solid processing agent is used up; and (g) requesting means for requesting replacement of all of said solid processing agents accommodated in all of said plurality of containers of said kit, responsive to the used-up signal.

2. The processing apparatus of claim 1, wherein the solid processing agents each comprise a tablet type of solid processing agent.

3. The processing apparatus of claim 1, wherein said residual amount detector further comprises:

a replenishment detector for detecting a replenishment amount of said solid processing agents that have been replenished into each of said plurality of processing tanks; and a non-replenishment detector for detecting an amount of said solid processing agents that have not been replenished into said plurality of processing tanks, wherein a residual amount is detected by said residual amount detector, based on (i) the value representing the amount of said solid processing agents stored in said memory, (ii) an output of said replenishment detector, and (iii) an output of said non-replenishment detector.

4. The processing apparatus of claim 1 further comprising:

inhibiting means for inhibiting a further replenishment of a residual amount of solid processing agents after a replacement of all solid processing agents has been requested.

5. A processing apparatus for a light-sensitive material, comprising:

(a) a plurality of processing tanks for processing a light-sensitive material;

(b) a detector for detecting an amount of said light-sensitive material which is actually processed, and for generating a signal when said actually detected processed amount of light-sensitive material reaches a predetermined value;

(c) a kit including a plurality of containers, said containers each being associated with respective processing tanks, and each container accommodating respective different solid processing agent, an amount of said solid processing agent in each of said containers being initially expected to be sufficient for processing a predetermined amount of the light sensitive material in each of said plurality of processing tanks;

(d) a memory for storing a value representing said amount of each of said solid processing agents initially expected to be sufficient for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers, and for outputting a used-up signal when it is detected that a solid processing agent in a container is used up; and (g) control means for controlling said replenishing means so as to replenish all of the other of said plurality of solid processing agents accommodated in all of the others of said containers of said kit, in response to the used-up signal.

6. The processing apparatus of claim 5, wherein the solid processing agents each comprise a tablet type of solid processing agent.

7. The processing apparatus of claim 5, wherein said residual amount detector further comprises:

a replenishment detector for detecting a replenishment amount of said solid processing agents that have been replenished into each of said plurality of processing tanks; and a non-replenishment detector for detecting an amount of said solid processing agents that have not been replenished into said plurality of processing tanks, wherein a residual amount is detected by said residual amount detector, based on (i) the value representing the amount of said solid processing agents stored in said memory, (ii) an output of said replenishment detector, and (iii) an output of said non-replenishment detector.

8. The processing apparatus of claim 5, further comprising:

requesting means for requesting replacement of each of said plurality of solid processing agents in response to the used-up signal.

9. A processing apparatus for a light-sensitive material, comprising:

(a) a plurality of processing tanks for processing a light-sensitive material (b) a detector for detecting an amount of said light-sensitive material which is processed, and for generating a signal when said detected processed amount of light-sensitive material reaches a predetermined value;

(c) a kit including a plurality of containers, said containers each being associated with respective processing tanks, and each container accommodating respective different solid processing agent used for processing a predetermined amount of the light sensitive material in each of said plurality of processing tanks;

(d) a memory for storing a value representing an amount of each of said solid processing agents used for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers, and for outputting a used-up signal when it is detected that a solid processing agent that is used up; and (g) requesting means for requesting replacement of all of said solid processing agents accommodated in all of said plurality of containers of said kit after (i) a generation of the used-up signal and (ii) when a processed amount of light-sensitive material reaches a replenishment delay critical value.

10. The processing apparatus of claim 9, wherein the solid processing agents each comprise a tablet type of solid processing agent.

11. The processing apparatus of claim 9, wherein said residual amount detector further comprises:

a replenishment detector for detecting a replenishment amount of said solid processing agents that have been replenished into each of said plurality of processing tanks; and a non-replenishment detector for detecting an amount of said solid processing agents that have not been replenished into said plurality of processing tanks, wherein a residual amount is detected by said residual amount detector, based on (i) the value representing the amount of said solid processing agents stored in said memory, (ii) an output of said replenishment detector, and (iii) an output of said non-replenishment detector.

12. The processing apparatus of claim 9, wherein said processed amount of light-sensitive material is determined by detecting a number of said signals generated by said detector, and said replenishment delay critical value corresponds to a predetermined number of said signals generated by said detector.

13. The processing apparatus according to claim 9, further comprising inhibiting means for inhibiting a replacement of each of said solid processing agents until a replacement of all solid processing agents has been requested and after the used-up signal is generated.

14. A processing apparatus for a light-sensitive material, comprising:

(a) a plurality of processing tanks for processing a light-sensitive material;

(b) a detector for detecting an amount of said light-sensitive material which is processed, and for generating a signal when said detected processed amount of light-sensitive material reaches a predetermined value;

(c) a kit including a plurality of containers, said containers each being associated with respective processing tanks, and each container accommodating respective different solid processing agent used for processing a predetermined amount of the light sensitive material in each of said plurality of processing tanks;

(d) a memory for storing a value representing an amount of each of said solid processing agents used for processing the predetermined amount of light-sensitive material;

(e) replenishing means for replenishing the solid processing agent accommodated in each said container into the associated respective plurality of processing tanks responsive to a signal generated by said detector; and (f) ratio correction means for changing a ratio between an amount of solid processing agent to be replenished and said predetermine value of said detected processed amount of said light-sensitive material.

15. The processing apparatus of claim 14, wherein said ratio correction means includes threshold value changing means for changing said predetermined value of said processed amount of light-sensitive material which is a threshold value for replenishment conducted by said replenishing means.

16. The processing apparatus of claim 15, wherein the threshold value changing means computes a changed threshold value based on a residual amount of the solid processing agents in one kit, and a residual amount of the light-sensitive material to be processed by the one kit.

17. The processing apparatus of claim 14, wherein said ratio correction means is operative when a value of an amount of the solid processing used for processing the light-sensitive material is subtracted from an amount of the solid processing agent required for processing the predetermined amount of light-sensitive material, and is different from an amount of the solid processing agent supplied to each processing tank.

18. The processing of apparatus of claim 14, wherein said ratio correction means changes said ratio such that a residual amount of the solid processing agent in each processing tank is substantially simultaneously reduced to zero.

19. The processing apparatus of claim 14, wherein said ratio correction means changes said ratio such that a sum of a remaining processing ability of each residual solid processing agent in each processing tank is substantially uniform.

20. The processing apparatus of claim 14, wherein said ratio correction means changes said ratio in accordance with a type of the solid processing agent which was not supplied to a processing tank, whether or not a change of a replenishment to other processing tanks is required.

21. A processing apparatus for a light-sensitive material, comprising:

(a) a plurality of processing tanks for processing a light-sensitive material (b) a detector for detecting an amount of said light-sensitive material which is processed, and for generating a signal when said detected processed amount of light-sensitive material reaches a predetermined value;

(c) a kit including a plurality of containers, said containers each being associated with respective processing tanks, and each container accommodating respective different solid processing agent used for processing a predetermined amount of the light sensitive material in each of said plurality of processing tanks;

(d) a memory for storing a value representing an amount of each of said solid processing agents used for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers and for outputting a used-up signal when it is detected that a solid processing agent is used up; and (g) requesting means for requesting replacement of all of said solid processing agents accommodated in all of said plurality of containers of said kit, responsive to the used-up signal; and wherein said residual amount detector further comprises:

a replenishment detector for detecting a replenishment amount of solid processing agents that have been replenished into each of said plurality of processing tanks; and a non-replenishment detector for detecting an amount of said solid processing agents that have not been replenished into said plurality of processing tanks, wherein a residual amount is detected by said residual amount detector, based on (i) the value representing the amount of said solid processing agents stored in said memory, (ii) an output of said replenishment detector, and (iii) an output of said non-replenishment detector.

22. A processing apparatus for a light-sensitive material, comprising:

(a) a plurality of processing tanks for processing a light-sensitive material;

(b) a detector for detecting an amount of said light-sensitive material which is processed, and for generating a signal when said detected processed amount of light-sensitive material reaches a predetermined value;

(c) a kit including a plurality of containers, said containers each being associated with respective processing tanks, and each container accommodating respective different solid processing agent used for processing a predetermined amount of the light sensitive material in each of said plurality of processing tanks;

(d) a memory for storing a value representing the initially expected amount of each of said solid processing agents used for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers, and for outputting a used-up signal when it is detected that a solid processing agent in a container is used up; and (g) control means for controlling said replenishing means so as to replenish all of the other of said plurality of solid processing agents accommodated in all of the others of said containers of said kit, in response to the used-up signal; and wherein said residual amount detector comprises:

a replenishment detector for detecting a replenishment amount of said solid processing agents that have been replenished into each of said plurality of processing tanks; and a non-replenishment detector for detecting an amount of said solid processing agents that have not been replenished into said plurality of processing tanks;

a residual amount of said solid processing agents being detected by said residual amount detector, based on (i) the value representing the amount of said solid processing agents stored in said memory, (ii) an output of said replenishment detector, and (iii) an output of said non-replenishment detector.

23. A processing apparatus for a light-sensitive material, comprising:

(a) a plurality of processing tanks for processing a light-sensitive material (b) a detector for detecting an amount of said light-sensitive material which is processed, and for generating a signal when said detected processed amount of light-sensitive material reaches a predetermined value;

(c) a kit including a plurality of containers, said containers each being associated with respective processing tanks, and each container accommodating respective different solid processing agent used for processing a predetermined amount of the light sensitive material in each of said plurality of processing tanks;

(d) a memory for storing a value representing an amount of each of said solid processing agents used for processing the predetermined amount of light-sensitive material;

(e) replenishing means for replenishing the solid processing agent accommodated in each said container into the associated respective plurality of processing tanks responsive to a signal generated by said detector;

(f) a residual amount detector for detecting a residual amount of each solid processing agent in each of said containers and for outputting a used-up signal when it is detected that a solid processing agent is used up;

(g) requesting means for requesting replacement of all of said solid processing agents accommodated in all of said plurality of containers of said kit, responsive to the used-up signal; and (h) inhibiting means for inhibiting a further replenishment of a residual amount of solid processing agents after a replacement of all solid processing agents has been requested.

* * * * *